US007319292B2

(12) United States Patent
Choi et al.

(10) Patent No.: US 7,319,292 B2
(45) Date of Patent: Jan. 15, 2008

(54) PLASMA DISPLAY PANEL AND METHOD OF DRIVING THE SAME

(75) Inventors: Sung Chun Choi, Anyang-si (KR); Jungwon Kang, Seoul (KR); Jun Weon Song, Seoul (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 10/791,691

(22) Filed: Mar. 3, 2004

(65) Prior Publication Data

US 2004/0233128 A1 Nov. 25, 2004

(30) Foreign Application Priority Data

| | | |
|---|---|---|
| Mar. 4, 2003 | (KR) | 10-2003-0013337 |
| Mar. 4, 2003 | (KR) | 10-2003-0013380 |
| Apr. 1, 2003 | (KR) | 10-2003-0020535 |
| Apr. 1, 2003 | (KR) | 10-2003-0020536 |
| Apr. 1, 2003 | (KR) | 10-2003-0020542 |

(51) Int. Cl.
*H01J 17/49* (2006.01)

(52) U.S. Cl. ..... 313/587; 313/582; 313/584; 313/585; 315/169.1; 315/169.4; 345/60

(58) Field of Classification Search ..... 313/583–585
See application file for complete search history.

(56) References Cited

U.S. PATENT DOCUMENTS

| | | | | |
|---|---|---|---|---|
| 5,789,862 | A * | 8/1998 | Makino | 313/584 |
| 6,376,995 | B1 * | 4/2002 | Kato et al. | 315/169.3 |
| 6,720,736 | B2 * | 4/2004 | Lee et al. | 315/169.3 |
| 6,984,936 | B2 * | 1/2006 | Chien et al. | 313/586 |

FOREIGN PATENT DOCUMENTS

KR 20040099054 * 11/2004

* cited by examiner

*Primary Examiner*—Sikha Roy
(74) *Attorney, Agent, or Firm*—Ked & Associates, LLP

(57) ABSTRACT

A plasma display panel is disclosed. More particularly, the present invention relates to a plasma display panel, which can improve discharge stability as well as brightness and efficiency. The plasma display panel according to the present invention includes transparent electrodes (ITO electrodes) spaced in parallel to each other at a predetermined distance; and metal electrodes each formed on the transparent electrodes (ITO electrodes) in parallel to the transparent electrodes (ITO electrodes) so that the respective transparent electrodes (ITO electrodes) are inclined toward the side where the transparent electrodes face.

8 Claims, 19 Drawing Sheets

PLASMA DISPLAY PANEL AND METHOD OF DRIVING THE SAME

BACKGROUND OF THE INVENTION

1. Field of the Invention

The present invention relates to a plasma display panel, and more particularly, to a plasma display panel and method for driving the same, which can increase discharge efficiency.

2. Background of the Related Art

A plasma display panel (hereinafter, referred to as "PDP") displays images including characters or graphics since fluorescent material is emitted by ultraviolet rays of 147 nm occurring when inert mixed gases of He+Xe, Ne+Xe, He+Ne+Xe, etc. are discharged. It is easy for this PDP to be made thin and large. The PDP also provides an improved picture quality due to recent advanced technology. In particular, in a 3-electrode AC sheet discharge PDP, wall charges are accumulated on the surface of the PDP upon the discharge of the PDP and electrodes are protected from sputtering occurring due to the discharge. Therefore, the 3-electrode AC sheet discharge PDP advantageously has a low-voltage driving and a long life span.

FIG. 1 is a perspective view illustrating a discharge cell structure, which is arranged in an AC-type PDP in a matrix shape, and FIG. 2 is a plane view illustrating a discharge cell structure of a plasma display panel.

Referring to FIG. 1 and FIG. 2, the discharge cell of the 3-electrode AC sheet discharge type PDP includes a scan electrode Y and a sustain electrode Z formed on an upper substrate 10, and an address electrode X formed on a lower substrate 17. Each of the scan electrode Y and the sustain electrode Z includes transparent electrodes 12Y and 12Z, and metal bus electrodes 13Y and 13Z having a line width smaller than those of the transparent electrodes 12Y and 12Z and formed in an edge region of one side of the transparent electrodes.

The transparent electrodes 12Y and 12Z are usually formed of indium-tin-oxide (hereinafter, referred to as "ITO") on the upper substrate 10. The metal bus electrodes 13Y and 13Z are formed on the transparent electrodes 12Y and 12Z usually using a metal such as chromium (Cr) and serve to reduce a voltage drop by the transparent electrodes 12Y and 12Z having a high resistance. An upper dielectric layer 14 and a protection film 16 are stacked on the upper substrate 10 in which the scan electrode Y and the sustain electrode Z are formed in parallel.

Wall charges occurred upon the plasma discharge is accumulated on the upper dielectric layer 14. The protection film 16 serves to prevent damage of the upper dielectric layer 14 due to sputtering generated upon the plasma discharge and to increase emission efficiency of secondary electrons. The protection film 16 is usually formed using magnesium oxide (MgO). A lower dielectric layer 22 and a diaphragm 24 are formed on the lower substrate 18 in which the address electrode X is formed. A fluorescent material layer 26 is covered on the lower dielectric layer 22 and the diaphragm 24.

The address electrode X is formed in the direction intersecting the scan electrode Y and the sustain electrode Z. The diaphragm 24 is formed in parallel to the address electrode X and serves to prevent ultraviolet rays and a visible ray generated due to the discharge from leaking toward neighboring discharge cells. The fluorescent material layer 26 is excited by ultraviolet rays generated upon the plasma discharge to generate a visible ray of one of red, green and blue.

Inert mixed gases such as He+Xe, Ne+Xe and He+Ne+Xe for discharge are inserted into a discharge space of the discharge cell formed between the upper/lower substrates 10, 18 and the diaphragm 24.

In such a 3-electrode AC sheet discharge type PDP, one frame is driven with it divided into several sub-fields having different numbers of emission in order to implement the gray level of a picture. Each sub-field is divided into a reset period for generating discharge uniformly, an address period for selecting a discharge cell and a sustain period for implementing the gray scale depending on the number of discharge.

For example, if it is desired to display a picture using 256 gray scales as in FIG. 3, the frame period 16.67 ms corresponding to 1/60 second is divided into eight sub-fields SF1 to SF8. Furthermore, each of the eight sub-fields SF1 to SF8 is divided into a reset and address period and a sustain period. In the above, the reset and address period of each sub-field are same every sub-field, whereas the sustain period is increased in the ratio of 2n(n=0, 1, 2, 3, 4, 5, 6, 7) in each sub-field. As such, since the sustain period varies in each sub-field, it is possible to implement the gray scale of the picture.

FIG. 4 shows a waveform illustrating the driving method of a plasma display panel in the prior art.

Referring to FIG. 4, the sub-field SF included in one frame of the PDP is driven with it divided into a reset period RPD for initializing the whole screen, an address period APD for selecting a cell, and a sustain period SPD for maintaining discharge of a selected cell.

In the reset period RPD, the reset pulse (RP) is applied to the scan electrode Y. The reset pulse (RP) has a ramp waveform and has a shape in which the voltage is increased in a set-up period and the voltage is reduced in a set-down period. In the set-up period where the voltage is gradually increased, a plurality of fine set-up discharges are generated and wall charges are thus formed on the upper dielectric layer. Thereafter, in the set-down period where the voltage is gradually decreased, unnecessary charged particles are partially erased by a plurality of fine set-down discharges, whereby the wall charges are reduced to the extent that they help a next address discharge while not causing erroneous discharge. During the set-down period, a DC voltage of the positive polarity (+) is supplied to the sustain electrode Z. Regarding the DC voltage of the positive polarity (+), the scan electrode Y become a relative negative polarity (−) against the sustain electrode Z upon the set-down since the reset pulse is supplied in a gradually reducing manner. In other words, the wall charges generated upon the set-up are reduced since the polarity is reversed.

During the address period APD, the scan pulse SP of the negative polarity (−) is sequentially applied to the scan electrode Y and at the same time the data pulse DP of the positive polarity (+) is applied to the address electrode X. As the voltage difference between the scan pulse SP and the data pulse DP and the wall voltage generated in the reset period RPD are added, an address discharge is generated within a cell to which the data pulse DP is applied. Wall charges are generated within the cell selected by the address discharge.

In the sustain period SPD, sustain pulses SUSPy and SUSPz are alternately applied to the scan electrode Y and the sustain electrode Z. Then, in the cell selected by the address discharge, sustain discharge of a sheet discharge shape is generated between the scan electrode Y and the sustain electrode Z every time when every sustain pulses SUSPy and SUSPz are applied, while the wall voltage and the sustain pulses SUSPy and SUSPz within the cell are added thereto.

In the erase period EPD following the sustain period SPD, discharge is stopped, which is kept since the erase pulse EP is applied to the sustain electrode Z. The erase pulse EP has a ramp waveform so that the amount of emission is small or a short pulse width of about 1 μs for discharge erase. The charged particles are erased due the short erase discharge by the erase pulse EP, stopping the discharge.

FIG. 5*a* is a view illustrating a light-emitting region that is divided upon the sustain discharge and FIG. 5*b* is a graph showing voltage distribution depending on the light-emitting region shown in FIG. 5*a*.

Referring to FIG. 5*a* and FIG. 5*b*, there is shown a divided region where an emission phenomenon occurs in a discharge space within a PDP cell upon the discharge. As shown in FIG. 5*a*, if a predetermined voltage is applied between the cathode (for example, the sustain electrode Z and the anode (for example, the scan electrode Y, discharge occurs between both the electrode due to emission of electrons. At this time, primary electrons emitted from the cathode are accelerated by an electric field applied between the two electrodes and thus collide with neutron particles, thus generating new electrons (i.e., secondary electrons).

The secondary electrons are strongly accelerated at a portion "A" in FIG. 5*b* where the amount of the electric field is relatively high as variation in the voltage is great. These secondary electrons continue to obtain energy while performing ionization, thereby reaching a region "B" in FIG. 5*b*. In the region "B" of FIG. 5*b*, the secondary electrons do not obtain energy any further and transfer neutron particles by collision. In this process, excited particles drop to the ground state to generate a visible ray and vacuum ultraviolet rays. This region is referred to as a negative glow region 2 as shown in FIG. 5*a*.

Electrons, which passed through the negative glow region 2, have very weak energy to generally represent a uniform plasma state. This region is called a positive column region 4 as shown in FIG. 5*a*. In the positive column 4, only electrons having high energy in the entire not energy by an electric field excite gas to emit light. In this positive column 4, ionization is rarely generated but emission by excitation is generated a lot. It is thus known that energy is converted to light in total to produce a good efficiency.

In the conventional 3-electrode structure, however, it is impossible to form a wide positive column having good discharge efficiency because the distance between the scan electrode Y and the sustain electrode Z is narrow. Due to this, the conventional 3-electrode structure has a disadvantage that the discharge efficiency is low. Accordingly, there is a need for a structure in which a wide positive column can be formed.

Furthermore, a PDP, which is currently commercialized, has efficiency of 1~1.5 lm/W. In some test sample level, efficiency of 2.0 lm/W has been reported. It can be said that such improvement in efficiency compared to the existing structure is caused due to the increase in the amount of Xe in a use gas from an adequate level to a high level 14% rather than structural improvement. In case of inert mixed gases such as Ne+Xe being currently used, the amount of Ne is about 95% and the amount of Xe is about 5%. Therefore, in order to increase discharge efficiency, the amount of Xe injected into the panel is raised to about 14%.

However, since the particle size of Xe is significantly larger than those of Ne, the path of charges is limited if the amount of Xe is high. Thus, a voltage for causing discharge must be increased. In other words, the increase in the amount of Xe results in increased breakdown and sustain voltage between the scan electrode Y and the sustain electrode Z. Furthermore, even in the driving, there occur a time delay in which discharge ignition is delayed due to an increased cooling effect of electrons by the application of a large amount of Xe, i.e., due to unsmooth migration of electrons as the particle size of Xe is significantly greater than that of Ne.

That is, the conventional PDP structure has a difficulty in increasing discharge efficiency without any problem such as time delay.

SUMMARY OF THE INVENTION

Accordingly, the present invention has been made in view of the above problems, and it is an object of the present invention to provide a plasma display panel and method for driving the same, wherein a positive column is expanded to increase discharge efficiency.

Another object of the present invention is to provide a method for driving a plasma display panel for preventing erroneous discharge.

To achieve these objects, in one aspect of the present invention, there is provided a plasma display panel according to the present invention, including a scan electrode and a sustain electrode, which are formed on an upper substrate in parallel to each other; and an address electrode formed on a lower substrate in the direction where the address electrode intersects the scan electrode and the sustain electrode, wherein a distance between the scan electrode and the sustain electrode is set wider than a distance between the scan electrode and the address electrode.

In another aspect of the present invention, a method for driving a plasma display panel, wherein the panel comprises a scan electrode and a sustain electrode, which are formed on an upper substrate in parallel to each other; and an address electrode formed on a lower substrate in the direction where the address electrode intersects the scan electrode and the sustain electrode, the method including the steps of: generating an opposite discharge between one of the scan electrode and the sustain electrode and the address electrode of the lower substrate, during a sustain period; and generating a sheet discharge between the scan electrode and the sustain electrode after the opposite discharge is generated.

In another aspect of the present invention, there is also provided a method for driving a plasma display panel, wherein the plasma display panel is driven with it divided into a plurality of sub-fields including a reset period, an address period and a sustain period, the method including the steps of: generating an address discharge for selecting a cell during the address period; supplying a first sustain pulse, which falls from a first voltage to a second voltage, to a scan electrode during the sustain period; alternately supplying the first sustain pulse and a second sustain pulse, which falls from the first voltage to the second voltage, to a sustain electrode; and supplying the first and second sustain pulses to the scan electrode and the sustain electrode and at the same time supplying a bias pulse of the positive polarity to an address electrode.

In another aspect of the present invention, there is also provided a method for driving a plasma display panel, wherein the plasma display panel is driven with it divided into a plurality of sub-fields including a reset period, an address period and a sustain period, the method including the steps of: generating an address discharge for selecting a cell during the address period; supplying a first sustain pulse, which falls from a first voltage to a second voltage, to a sustain electrode during the sustain period; alternately supplying the first sustain pulse and a second sustain pulse, which falls from the first voltage to the second voltage, to a scan electrode; and supplying the first and second sustain pulses to the scan electrode and the sustain electrode and at the same time supplying a bias pulse of the positive polarity to an address electrode.

In another aspect of the present invention, there is also provided a method for driving a plasma display panel, wherein the panel is driven with it divided into a plurality of sub-fields including a reset period, an address period and a sustain period, wherein the plasma display panel includes a scan electrode and a sustain electrode which are formed in parallel to a discharge cell at a first distance; and an address electrode formed to intersect a discharge cell at a second distance narrower than the first distance between the scan electrode and the sustain electrode, the method including the steps of: generating an address discharge for selecting a cell during the address period; supplying a first sustain pulse, which falls from a first voltage to a second voltage, to a scan electrode during the sustain period; alternately supplying the first sustain pulse and a second sustain pulse, which falls from the first voltage to the second voltage, to a sustain electrode; and supplying the first and second sustain pulses to the scan electrode and the sustain electrode and at the same time supplying a bias pulse of the positive polarity to an address electrode.

In another aspect of the present invention, there is also provided a method for driving a plasma display panel, wherein the plasma display panel is driven with it divided into a plurality of sub-fields including a reset period, an address period and a sustain period, and includes a scan electrode and a sustain electrode which are formed in parallel to a discharge cell at a first distance; and an address electrode formed to intersect a discharge cell at a second distance narrower than the first distance between the scan electrode and the sustain electrode, the method including the steps of: generating an address discharge for selecting a cell during the address period; supplying a first sustain pulse, which falls from a first voltage to a second voltage, to a sustain electrode during the sustain period; alternately supplying the first sustain pulse and a second sustain pulse, which falls from the first voltage to the second voltage, to a scan electrode; and supplying the first and second sustain pulses to the scan electrode and the sustain electrode and at the same time supplying a bias pulse of the positive polarity to an address electrode.

In another aspect of the present invention, there is also provided a method for driving a plasma display panel, wherein the plasma display panel is driven with it divided into a plurality of sub-fields including a reset period, an address period and a sustain period, the method including the steps of: generating an address discharge for selecting a cell during the address period; supplying a first sustain pulse, which falls from a first voltage to a second voltage, to a scan electrode during the sustain period; alternately supplying the first sustain pulse and a second sustain pulse, which falls from the first voltage to the second voltage, to a sustain electrode during the sustain period; and supplying an erase pulse having a voltage value of the negative polarity to the scan electrode after the sustain period.

In another aspect of the present invention, there is also provided a method for driving a panel, wherein the plasma display panel is driven with it divided into a plurality of sub-fields including a reset period, an address period and a sustain period, and wherein the plasma display panel includes a scan electrode and a sustain electrode which are formed in parallel to a discharge cell at a first distance; and an address electrode formed to intersect a discharge cell at a second distance narrower than the first distance between the scan electrode and the sustain electrode, the method including the steps of: generating an address discharge for selecting a cell during the address period; supplying a first sustain pulse, which falls from a first voltage to a second voltage, to a scan electrode during the sustain period; alternately supplying the first sustain pulse and a second sustain pulse, which falls from the first voltage to the second voltage, to a sustain electrode during the sustain period; and supplying an erase pulse having a voltage value of the negative polarity to the scan electrode after the sustain period.

In another aspect of the present invention, there is also provided a method for driving a plasma display panel, wherein plasma display panel is driven with a reset period divided into a set-up period and a set-down period, the method including the steps of: supplying a first ramp-up waveform, which rises from a first voltage value to a peak voltage, to a scan electrode during the set-up period; supplying a second ramp-up waveform to a sustain electrode formed in parallel to the scan electrode during the set-up period; and supplying a ramp-down waveform, which falls from a second voltage value lower than the first voltage value to a third voltage value, to the scan electrode during the set-down period.

In another aspect of the present invention, there is also provided a method for driving a plasma display panel wherein the plasma display panel is driven with a reset period divided into a set-up period and a set-down period, wherein the plasma display panel includes a scan electrode and a sustain electrode which are formed in parallel to a discharge cell at a first distance; and an address electrode formed to intersect a discharge cell at a second distance narrower than the first distance between the scan electrode and the sustain electrode, the method including the steps of: supplying a first ramp-up waveform, which rises from a first voltage value to a peak voltage, to a scan electrode during the set-up period; supplying a second ramp-up waveform to a sustain electrode formed in parallel to the scan electrode during the set-up period; and supplying a ramp-down waveform, which falls from a second voltage value lower than the first voltage value to a third voltage value, to the scan electrode during the set-down period.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

First Embodiment

Figure 1:
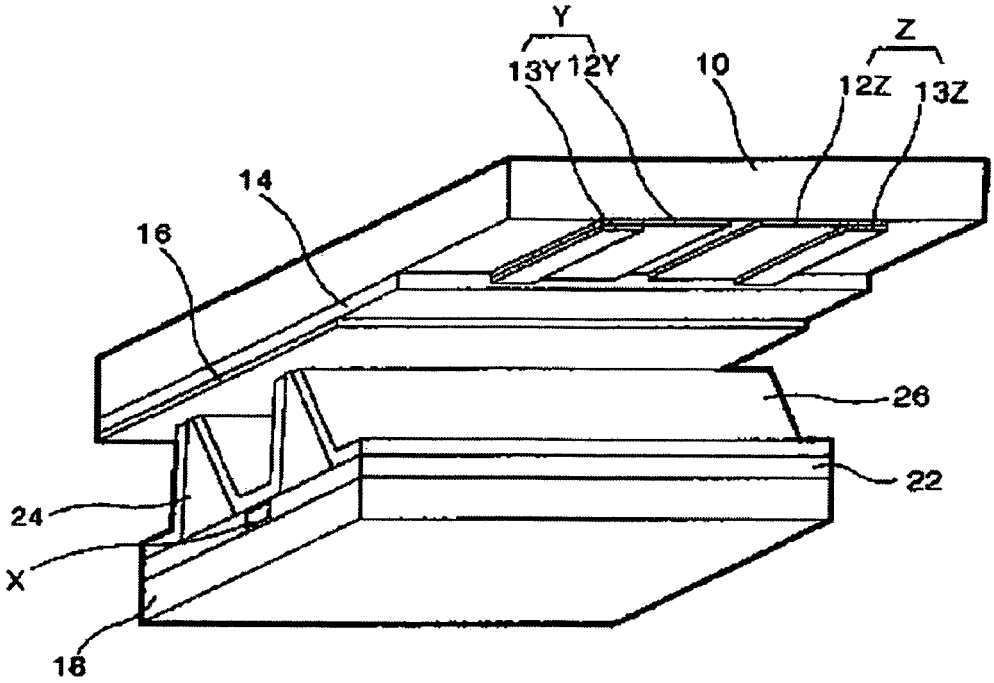
Fig. 1 (Related Art)
FIG. 1 is a perspective view illustrating a discharge cell of a plasma display panel in the related art.
Figure 2:
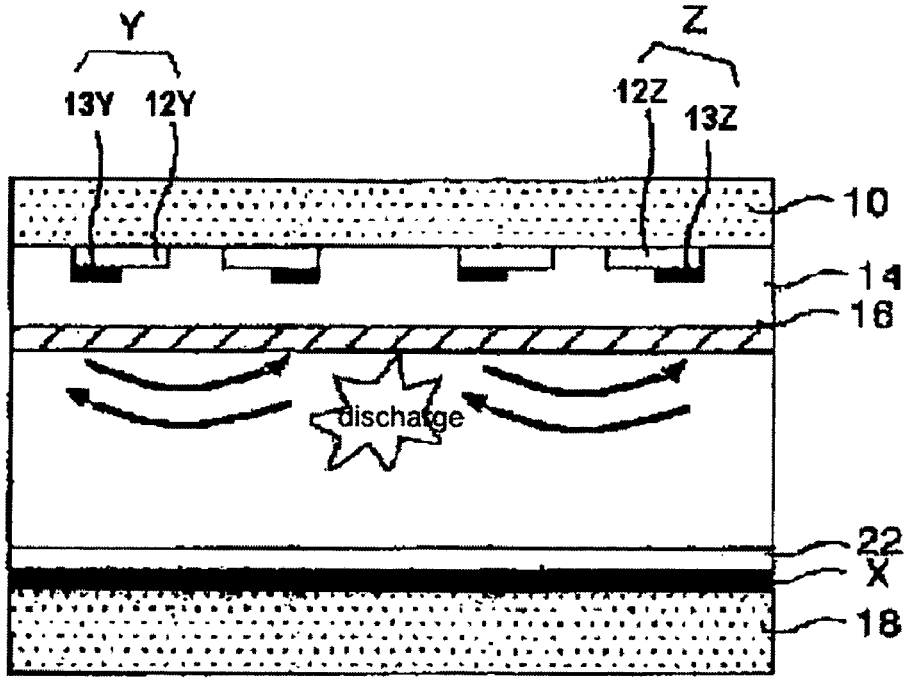
Fig. 2 (Related Art)
FIG. 2 is a plane view illustrating a pair of sustain electrodes shown in FIG. 1.
Figure 3:
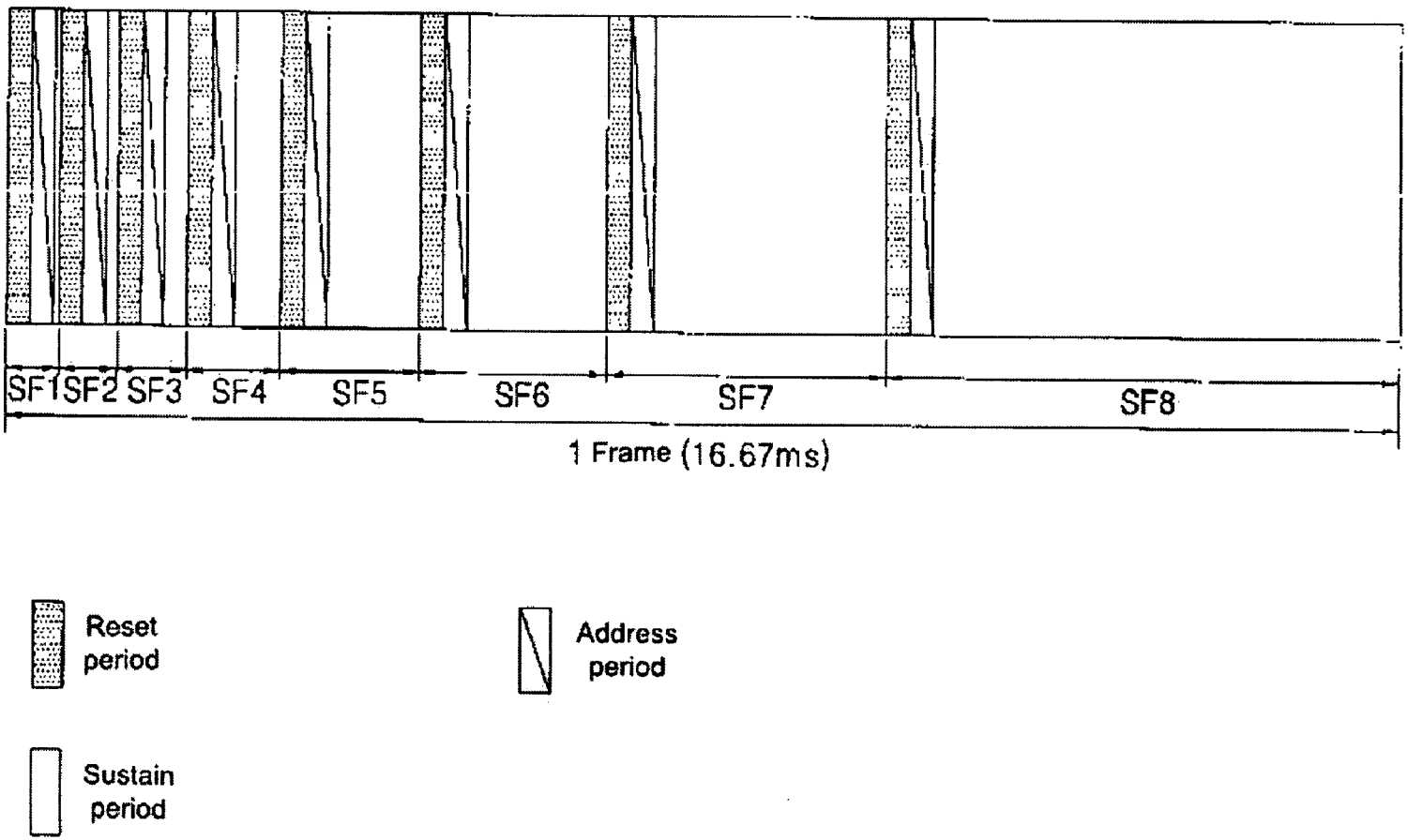
Fig. 3 (Related Art)
FIG. 3 is a view illustrating one frame of a plasma display panel shown in FIG. 1.
Figure 4:
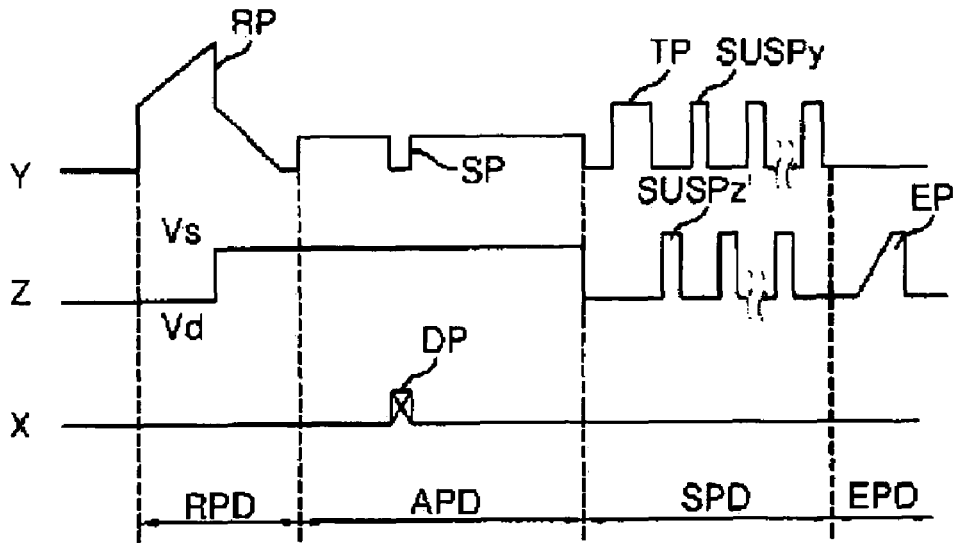
Fig. 4 (Related Art)
FIG. 4 shows a waveform illustrating the driving method of a plasma display panel in the prior art.
Figure 5A:
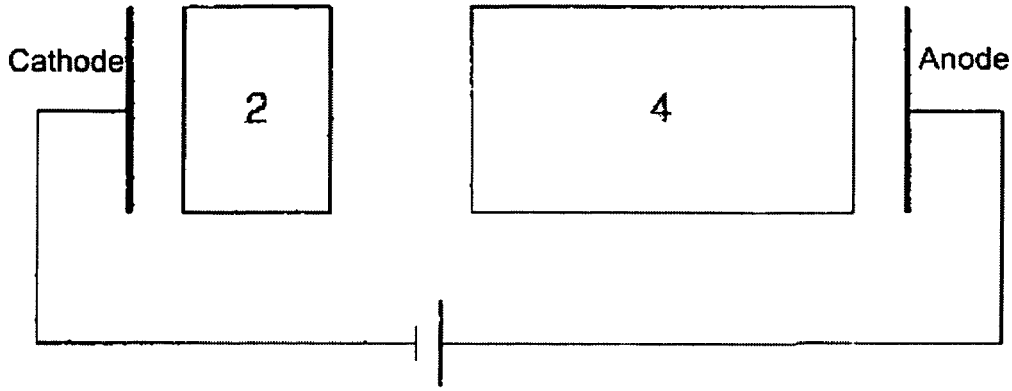
Fig. 5a (Related Art)
FIG. 5*a* is a view illustrating a light-emitting region that is divided upon the sustain discharge.
Figure 5B:
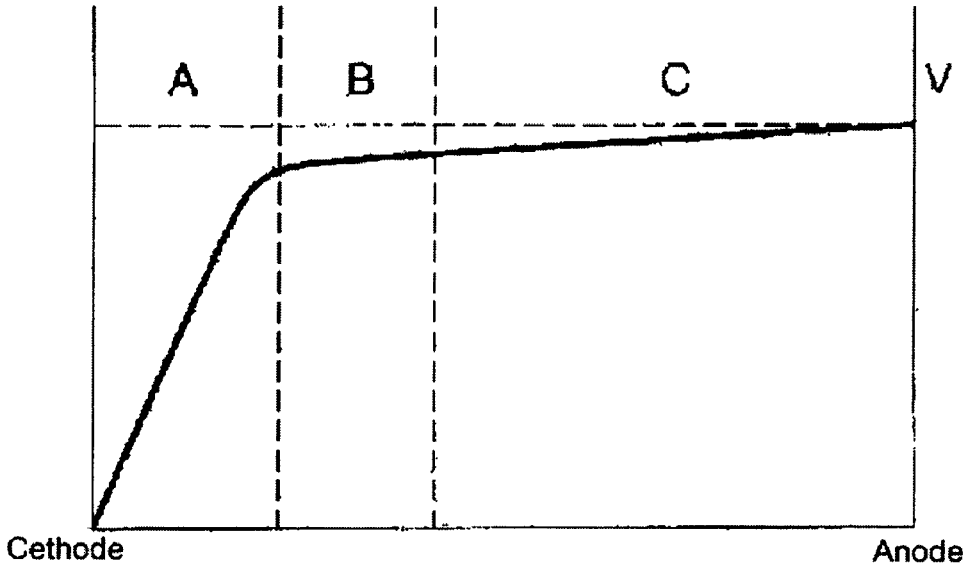
Fig. 5b (Related Art)
FIG. 5*b* is a graph showing voltage distribution depending on the light-emitting region shown in FIG. 5*a;*
Figure 6:
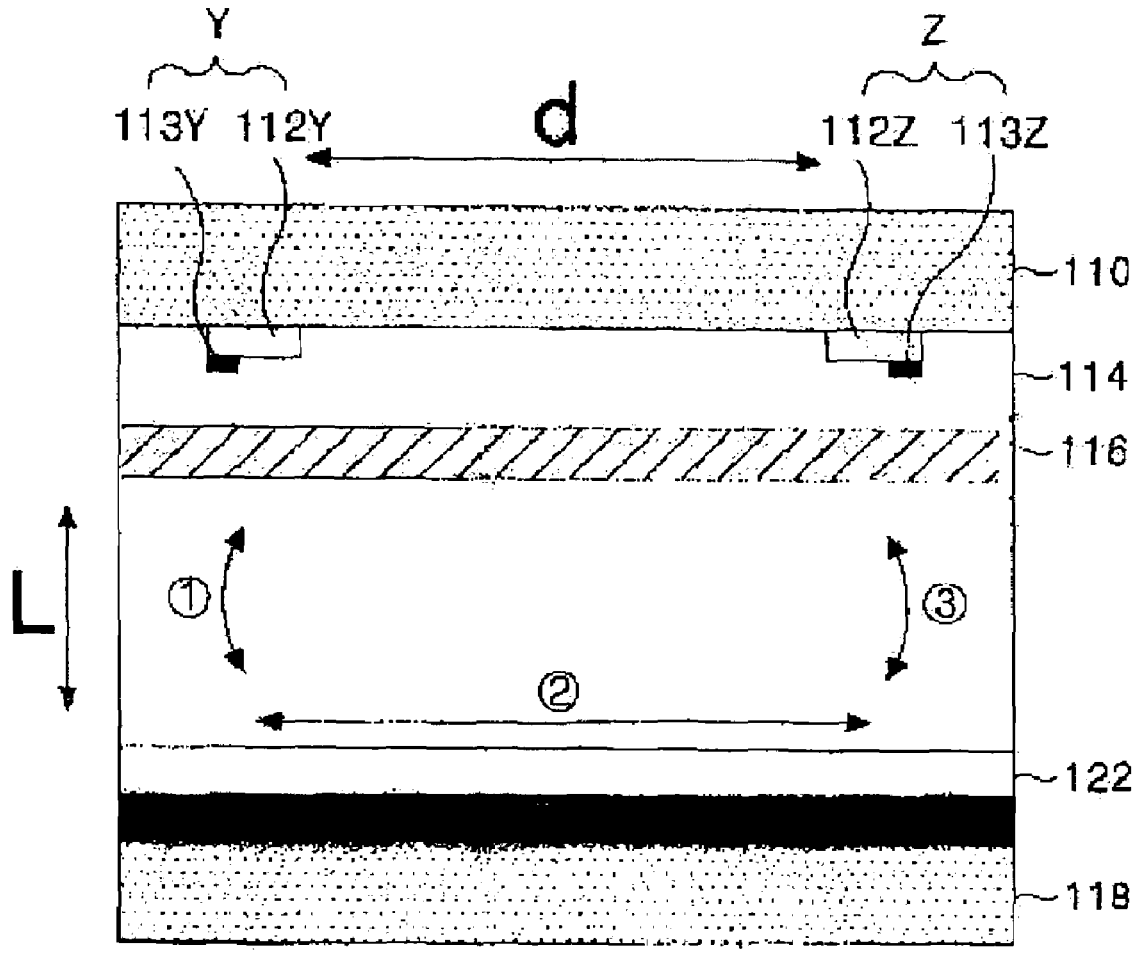
FIG. 6 is a cross-sectional view of a PDP according to an embodiment of the present invention.

FIG. 6 is a cross-sectional view of a PDP according to an embodiment of the present invention.

Referring to FIG. 6, a discharge cell of a 3-electrode AC sheet discharge type PDP using a positive column according to a first embodiment of the present invention includes a scan electrode Y and a sustain electrode Z formed on an upper substrate 110, and an address electrode X formed on a lower substrate 118. Each of the scan electrode Y and the sustain electrode Z includes transparent electrodes 112Y and 112Z, and metal bus electrodes 113Y and 113Z having a line width smaller than a line width of the transparent electrodes 112Y and 112Z and formed in an edge region of one side of the transparent electrode.

The transparent electrodes 112Y and 112Z are usually formed of indium-tin-oxide (hereinafter, referred to as "ITO") on the upper substrate 10. The metal bus electrodes 113Y and 113Z are formed on the transparent electrodes 112Y and 112Z usually using a metal such as chromium (Cr) and serve to reduce a voltage drop by the transparent electrodes 112Y and 112Z having a high resistance. An upper dielectric layer 114 and a protection film 116 are stacked on the upper substrate 110 in which the scan electrode Y and the sustain electrode Z are formed in parallel.

Wall charges occurred upon the plasma discharge is accumulated on the upper dielectric layer 114. The protection film 116 serves to prevent damage of the upper dielectric layer 114 due to sputtering generated upon the plasma discharge and to increase emission efficiency of secondary electrons. The protection film 116 is usually formed using magnesium oxide (MgO). A lower dielectric layer 122 and a diaphragm 124 are formed on a lower substrate 118 in which the address electrode X is formed. A fluorescent material layer 126 is covered on the lower dielectric layer 122 and the diaphragm 124. In the above, the address electrode X are formed in the direction intersecting the scan electrode Y and the sustain electrode Z.

The diaphragm is formed in parallel to the address electrode X to prevent ultraviolet rays and a visible ray generated by discharge from leaking toward neighboring discharge cells. The fluorescent material layer is excited by the ultraviolet rays generated upon the plasma discharge to generate a visible ray of one of red, green and blue. Inert mixed gases for discharge such as Ne+Xe are injected into a discharge space of the discharge cell between the upper/lower substrates 110, 118 and the diaphragm. In such a PDP according to the present invention PDP, a distance d between the scan electrode Y and the sustain electrode Z formed on the upper substrate 110 is set wider than a distance L between the scan electrode Y and the address electrode X (or a distance L between the sustain electrode Z and the address electrode X).

Meanwhile, in the conventional 3-electrode structure, it is impossible to form the positive column widely because the distance between the scan electrode Y and the sustain electrode Z is narrow. In the present invention, however, it is possible to form the positive column widely since the distance between the scan electrode Y and the address electrode X is set narrow and the distance between the scan electrode Y and the sustain electrode Z is set wide. Accordingly, the structure of the present invention can increase discharge efficiency compared to the conventional 3-electrode structure.

In other words, when the sustain pulse is applied to the scan electrode Y during the sustain period, the distance between the scan electrode Y and the sustain electrode Z is set wider than the distance between the scan electrode Y and the address electrode X. Thus, discharge between the scan electrode Y and the address electrode X first occurs, and a sustain discharge between the scan electrode Y and the sustain electrode Z then occurs. That is, discharge between the scan electrode Y and the address electrode X serves as a trigger so that discharge between the scan electrode Y and the sustain electrode Z can more easily occur.

Therefore, in the sustain period SPD, the voltage difference between the scan electrode Y and the address electrode X becomes greater than that between the scan electrode Y and the sustain electrode Z. The opposite discharge between the scan electrode Y and the address electrode X first occurs.

In the concrete, the distance d between the scan electrode Y and the sustain electrode Z is set wider than the distance L between the scan electrode Y and the address electrode X, the voltage difference between the scan electrode Y and the address electrode X becomes higher than that between the scan electrode Y and the sustain electrode Z. Thus, when the sustain pulse is applied to the scan electrode Y, opposite discharge between the scan electrode Y and the address electrode X first occurs in the direction ① in FIG. 6.

Thereafter, electrons form the positive column, while diffusing in the direction ② in FIG. 6, due to a high voltage difference between the scan electrode Y and the sustain electrode Z. At the point of time when the positive column ends, opposite discharge between the sustain electrode Z and the address electrode X occurs in the direction ③ in FIG. 6.

Similarly, when the sustain pulse is alternately applied between the sustain electrode Z and the scan electrode Y, opposite discharge between the sustain electrode Z and the address electrode X first occurs in the direction ③ in FIG. 6. Thereafter, electrons form the positive column, while diffusing in the direction ② in FIG. 6, due to a high voltage difference between the scan electrode Y and the sustain electrode Z. At the point of time when the positive column ends, opposite discharge between the sustain electrode Z and the address electrode X occurs in the direction ① in FIG. 6. As such, it is possible to form a positive column having a good discharge efficiency by setting the distance d between the scan electrode Y and the sustain electrode Z to be wider than the distance L between the scan electrode Y and the address electrode X.

Therefore, the PDP using the positive column according to the present invention can implement a high efficiency comparable to what a large amount of Xe is applied to a common structure having a general amount of Xe. To this end, a positive column having a low field and a high Xe excitation rate are actively utilized in addition to a negative glow region currently used in the AC-type PDP.

Generally, the positive column is generated when it has a discharge pass of over 300 μm and shows high efficiency (approximately 7 lm/W) compared to efficiency of 1~2 lm/W in the negative glow region. In order to expand the positive column, the distance (=d) between ITO within the cell is maximized (ITO distance is over 300 μm in a 0.81 mm pixel pitch basis). Further, for the purpose of a discharge start and an increase in the sustain voltages depending on the increase in the distance between ITO, the discharge start during the sustain period SPD is accomplished between the scan electrode Y and the address electrode X not between the conventional scan electrode Y and sustain electrode Z, while the distance (=L) between the scan electrode Y and the address electrode X keeps d>L, so that the discharged is moved to the sustain electrode Z. For this, the relationship of d>L is inevitable.

In other words, in order to form a wide positive column, the distance d between the scan electrode Y and the sustain electrode Z is set wider than the distance L between the scan electrode Y and the address electrode X, thus increasing discharge efficiency.

Figure 7A:
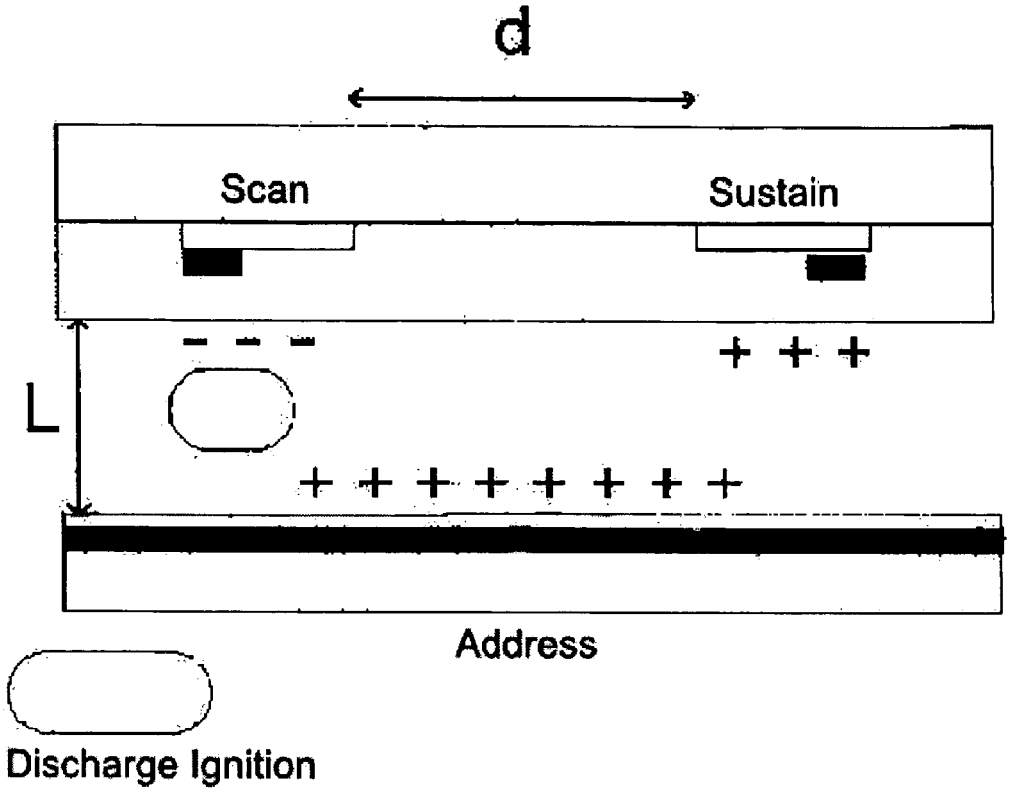
FIG. 7*a* is a diagram illustrating the discharge start and sustain during the sustain period in a positive column structure of a horizontal shape shown in FIG. 6.
Figure 7B:
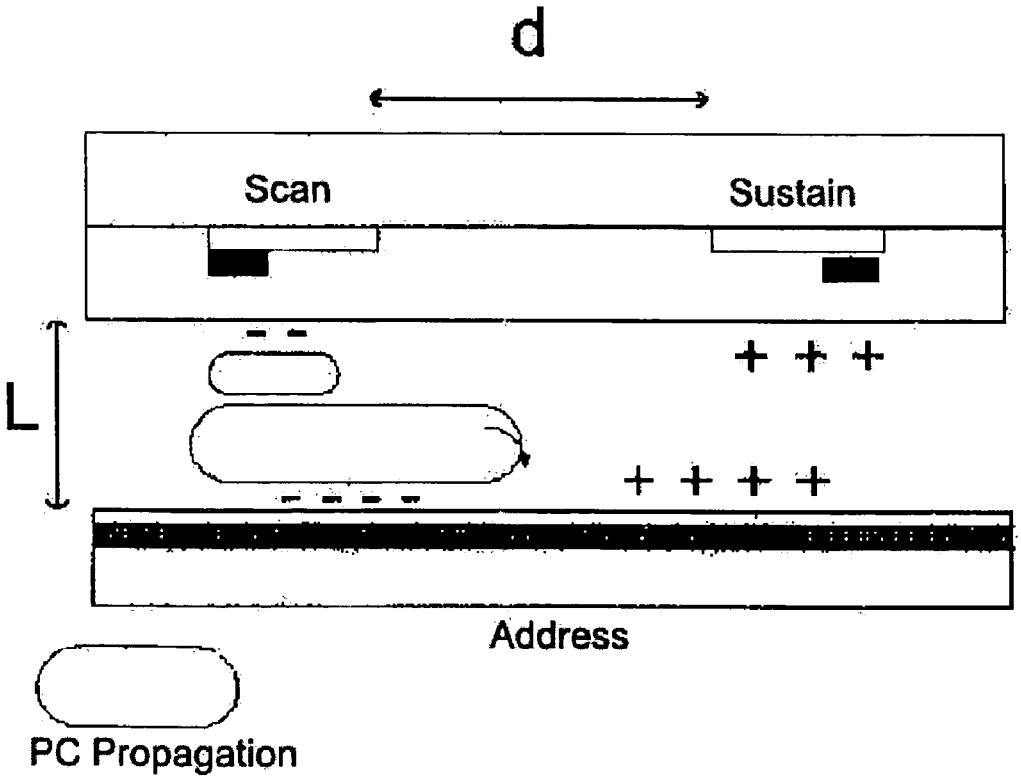
FIG. 7*b* is a diagram illustrating the discharge start and sustain during the sustain period in a positive column structure of a horizontal shape shown in FIG. 6.
Figure 7C:
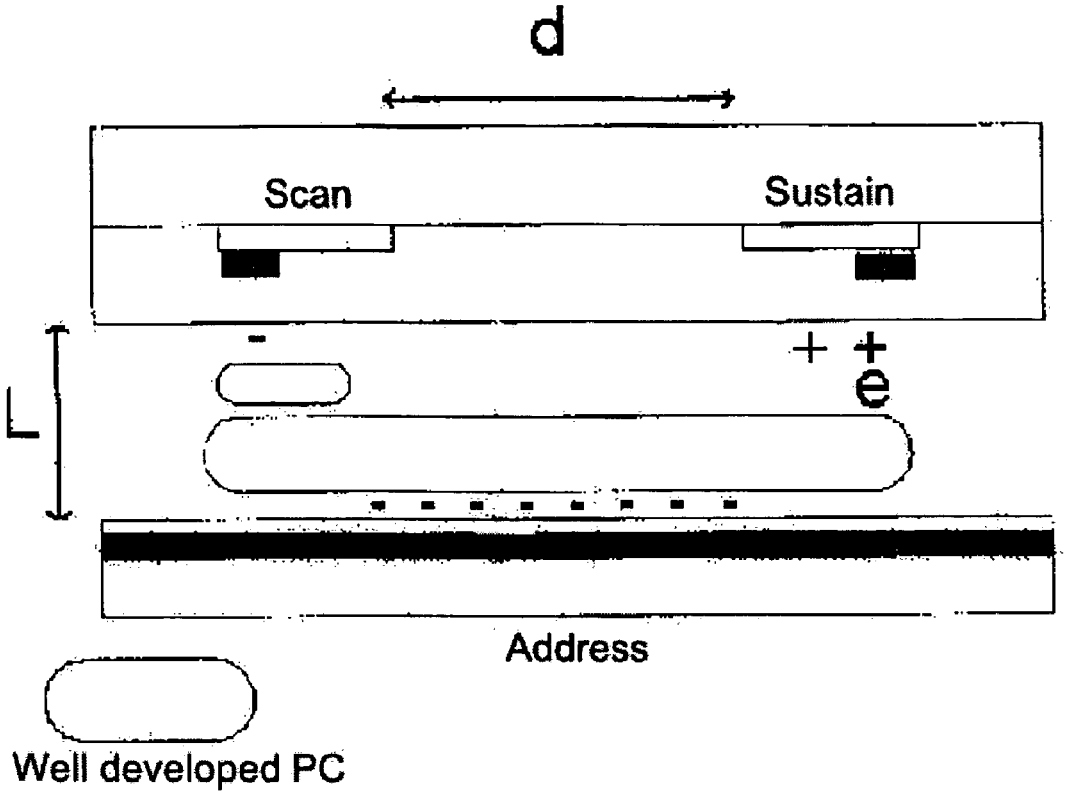
FIG. 7*c* is a diagram illustrating the discharge start and sustain during the sustain period in a positive column structure of a horizontal shape shown in FIG. 6.

FIG. 7*a* to 7*c* are diagrams illustrating the-discharge start and sustain during the sustain period in the positive column structure of the horizontal shape shown in FIG. 6.

Referring to FIG. 7*a* to 7*c*, in the sustain period SPD, the distance between the scan electrode Y and the address electrode X is relatively narrower than the distance between the scan electrode Y and the sustain electrode Z, as in FIG. 7*a*. Thus, sheet discharge does not occur between the scan electrode Y and the sustain electrode Z, but weak opposite discharge occurs between the scan electrode Y and the address electrode X.

Thereafter, since d>L as in FIG. 7*b*, electrons form the positive column, while diffusing toward the sustain electrode Z, by means of the voltage difference between the scan electrode Y and the sustain electrode Z. Next, as in FIG. 7*c*, as the positive column continues to diffuse, at the end of time, the voltage difference between the scan electrode Y and the sustain electrode Z is offset by accumulation of charges having an opposite polarity.

Therefore, the polarity of the wall charge of each electrode become reverse or neutral while the discharge becomes gradually weak. In such a positive column, only electrons having high energy not energy by the electric field are excited using gases to emit light.

In other words, in the positive column, ionization rarely occurs but emission by excitation occurs a lot. Therefore, efficiency is generally increased since a lot of energy is converted to light. Therefore, if this positive column is maximized, discharge efficiency will be increased. In order to expand the positive column, the distance between ITO between discharge cells is maximized to increase the discharge efficiency.

Figure 8A:
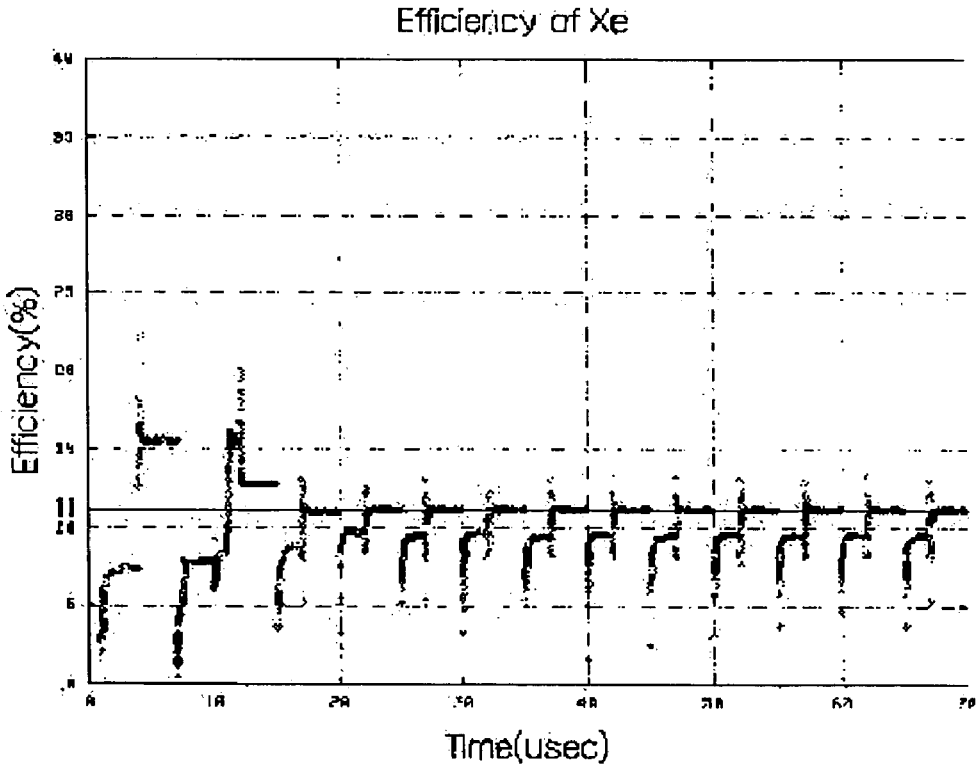
FIG. 8*a* is a graph illustrating efficiency of an electrode structure according to the prior art.
Figure 8B:
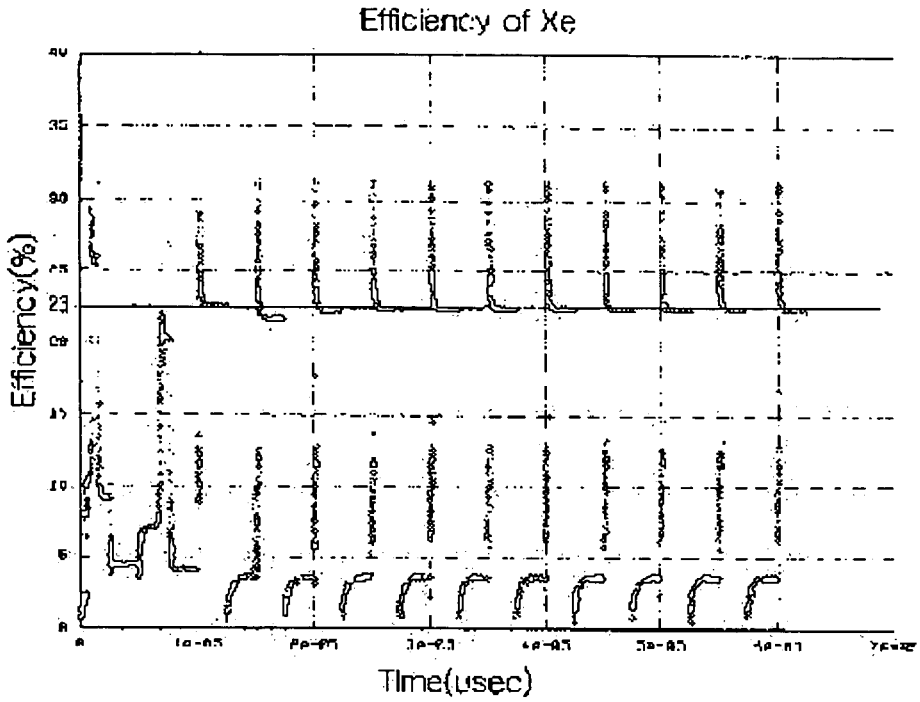
FIG. 8*b* is a graph illustrating efficiency of a positive column electrode structure according to the prior art.

FIG. 8*a* and FIG. 8*b* are graphs illustrating efficiency of the conventional electrode structure and the electrode structure of the positive column.

Referring to FIG. 8*a* and FIG. 8*b*, Xe of 5% is injected and a Xe—Ne gas having a pressure of 500 Torr is sealed. From the graph shown in FIG. 8*a*, it can be seen that the discharge efficiency of the conventional electrode structure is 11%. In other words, a portion, which instantly falls and then becomes constant in the graph, indicates the discharge efficiency. Meanwhile, from the graph shown in FIG. 8*b*, it can be seen that the discharge efficiency of the positive column electrode structure according to the present invention is 23%. In other words, a portion, which instantly rises and falls and then becomes constant in the graph, indicates the discharge efficiency of the positive column electrode structure. Consequently, it can be seen that the positive column structure of the present invention has further improved discharge efficiency compared to the conventional electrode structure, while the same amount of Xe is injected.

Figure 9:
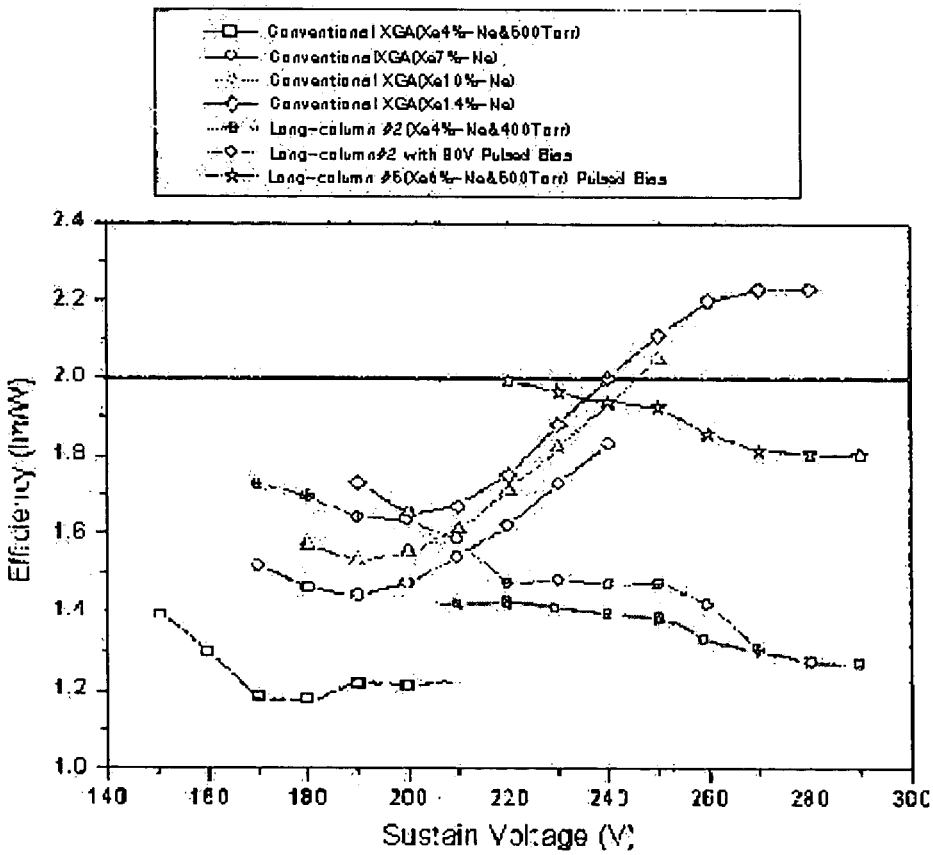
FIG. 9 is a graph illustrating efficiency of an electrode structure and a positive column electrode structure.

Meanwhile, referring to FIG. 9 showing the result that a visible efficiency is compared with the conventional sample using a 6.5 inch test sample, in the positive column structure in which Xe of 6% is injected, a Xe—Ne gas having a pressure of 500 Torr is sealed and a bias pulse of the positive polarity is applied thereto, a sustain voltage of about 220V is required in order to have efficiency of about 2.0 lm/W. In the conventional electrode structure in which Xe of 14% is injected and a Xe—Ne gas is sealed, however, a sustain voltage of about 220V is required in order to have efficiency of 2.0 lm/W.

This shows an example that efficiency of the positive column structure is improved using the positive column, which is difficult to be used in a common structure. Alternatively, it is possible to obtain improved efficiency of 10~20% even in the same structure by applying the bias pulse of the positive polarity to the address electrode X for the purpose of discharge start and sustain at a lower voltage.

Figure 10:
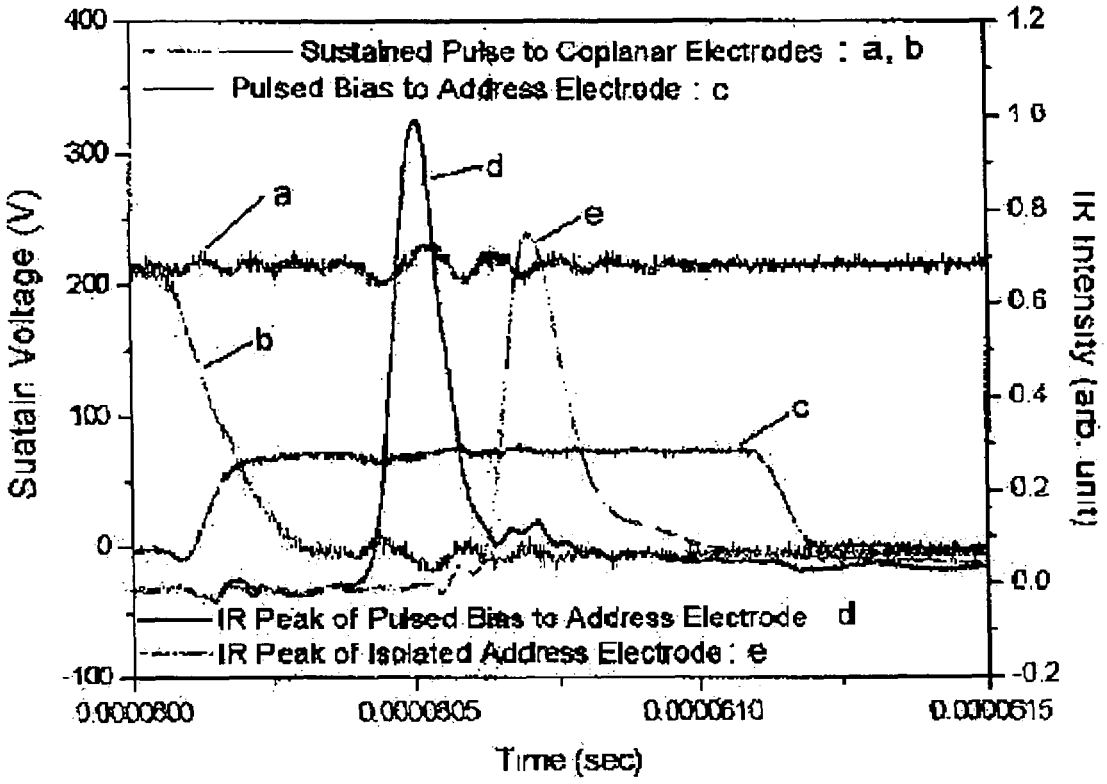
FIG. 10 is a graph illustrating a case where the pulse of the positive polarity is applied to the address electrode.

FIG. 10 is a graph illustrating a case where the pulse of the positive polarity is applied to the address electrode.

Referring to FIG. 10, when the sustain pulses SUSPy and SUSPz are applied to the scan electrode Y and the sustain electrode Z during the sustain period SPD, if a pulsed bias of positive polarity is applied to the address electrode X so that the pulsed bias and the sustain pulses are synchronized, the voltage difference between the scan electrode Y and the address electrode X is generated more greatly to easily cause discharge between the scan electrode Y and the address electrode X. This may cause the discharge sustain voltage to drop and the amount of excited Xe to increase. At this time, the sustain pulses SUSPy and SUSPz supplied to the scan electrode Y and the sustain electrode Z are a pulse having a voltage value, which falls from the sustain voltage Vs to the ground voltage GND.

In the concrete, "a" and "b" in the graph shown in FIG. 10 indicate the sustain pulses SUSPy and SUSPz applied to the scan electrode Y and the sustain electrode Z, and "c" indicates the pulsed bias of the positive polarity, which is applied to the address electrode X so that the pulsed bias and the sustain pulses SUSPy and SUSPz are synchronized when the sustain pulses SUSPy and SUSPz are applied. Also, "d" and "e" designate the amount of infrared rays, which are emitted when the pulsed bias of the positive polarity is applied to the address electrode X and when the pulsed bias of the positive polarity is not applied to the address electrode X.

In other words, upon discharge between the scan electrode Y and the address electrode X during the sustain period SPD, if the pulsed bias of the positive polarity is not applied to the address electrode X, not only the amount of infrared rays emitted by discharge between the scan electrode Y and the address electrode X is small as indicated by "e" in FIG. 10 but also a time delay that discharge occurs late is generated.

Therefore, when the sustain pulses SUSPy and SUSPz are supplied, the pulsed bias of the positive polarity as indicated by "c" in FIG. 10 is applied to the address electrode X so that the sustain pulses and the pulsed bias are synchronized. In other words, the sustain pulses SUSPy and SUSPz having a voltage value, which falls from the sustain voltage Vs to the ground voltage GND, are applied to the scan electrode Y or the sustain electrode Z. Also, a pulse having a width smaller than that of the sustain pulses SUSPy and SUSPz having a voltage value, which rises from the ground voltage GND to a predetermined voltage, are applied to the address electrode X so that the pulse is synchronized with the sustain pulses. Accordingly, upon the sustain discharge due to a high voltage difference between the scan electrode Y or the sustain electrode Z and the address electrode X, not only a large amount of infrared rays can be emitted like "d" in FIG. 10 but also discharge quickly occurs, reducing a time delay.

Figure 11:
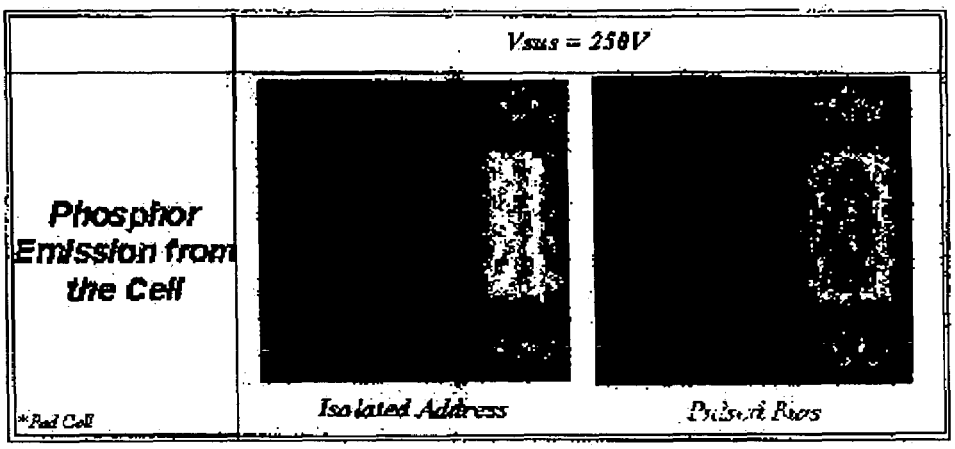
FIG. 11 shows a photograph of a visible ray occurring in a red sub-pixel.

At this time, comparing when a pulsed bias of the positive polarity is applied to the address electrode X and when the pulsed bias of the positive polarity is not applied to the address electrode X during the sustain period SPD, from FIG. 11 showing a photograph of the amount of a visible ray occurring in the red sub-pixel, it can be seen that more stronger visible ray is generated at the center of the discharge cell when the pulsed bias of the positive polarity is applied to the address electrode X.

Second Embodiment

A PDP according to a first embodiment of the present invention is a structure using he positive column. In this structure, the distance between the scan electrode and the sustain electrode is set wider than the distance between the scan electrode and the address electrode. Thus, the sustain voltage Vs is a little high compared to the conventional structure. It can be said that this problem is basically derived from the relationship d>L in FIG. 7. Accordingly, the first embodiment and another embodiment for lowering the sustain voltage Vs a little in a safe manner will be described.

Figure 12A:
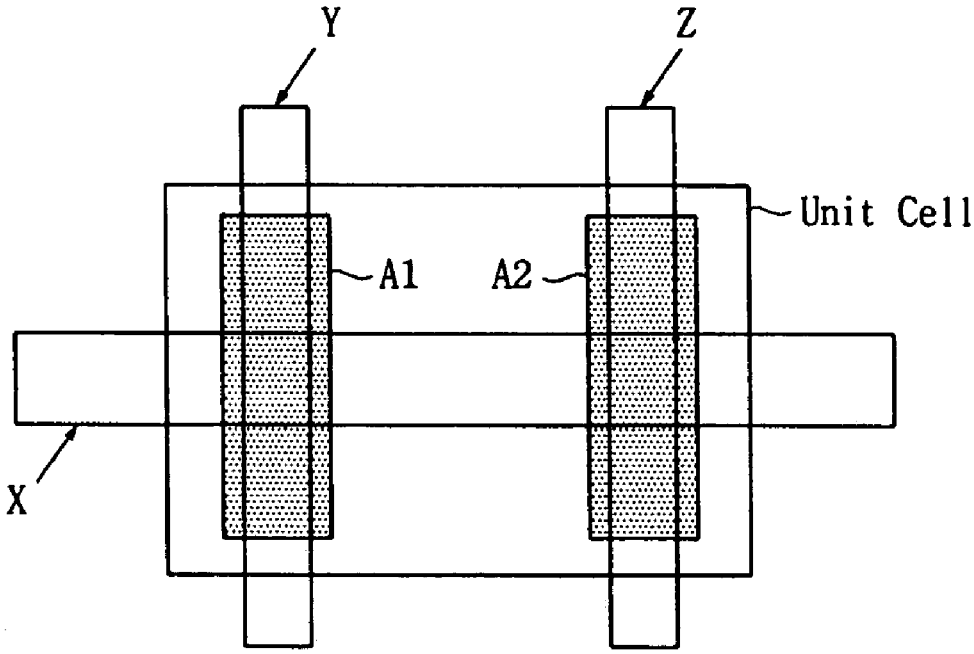
FIG. 12*a* shows an electrode structure according to a second embodiment of the present invention.
Figure 12B:
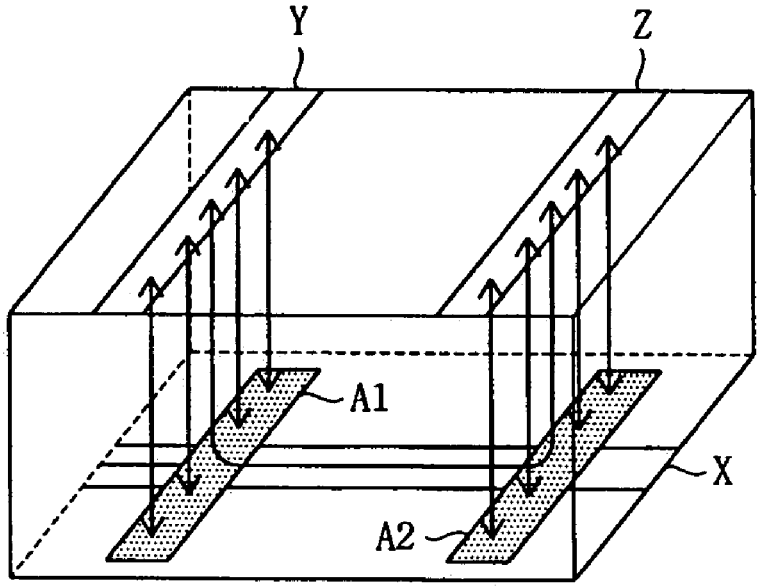
FIG. 12*b* shows an electrode structure according to a second embodiment of the present invention.

FIGS. 12*a* and 12*b* show electrode structures according to a second embodiment of the present invention.

Referring to FIGS. 12*a* and 12*b*, the electrode structure includes a scan electrode Y and a sustain electrode Z which are formed in parallel to each other on a upper substrate, an address electrode X formed on a lower substrate so that the address electrode X intersects the scan electrode Y and the sustain electrode Z, and auxiliary electrodes A1 and A2 formed on the address electrode X at places where the scan electrode Y and the sustain electrode Z and the address electrode X intersect.

In the above, the auxiliary electrodes A1 and A2 have a width wider than that of the scan electrode Y and the sustain electrode Z. Furthermore, these auxiliary electrodes A1 and A2 may be formed on the part of only one side of the scan electrode Y and the sustain electrode Z and may be formed in such a manner as to extend only in one direction of each electrode.

By doing so, upon opposite discharge between the scan electrode Y or the sustain electrode Z and the address electrode X, a large amount of wall charges can be accumulated on a dielectric layer of the scan electrode Y and the sustain electrode Z. These wall charges serve to lower the sustain voltage Vs applied upon the sustain discharge. In other words, the sustain discharge can occur even when the sustain voltage Vs is relatively low because the wall voltage is increased in the relationship Vs+Vw>Vf. In the above, Vs indicates the sustain voltage and Vw indicates the wall voltage formed in the dielectric layer. Further, Vf is a firing Voltage, which indicates a breakdown voltage being a minimum voltage which is capable of causing the sustain discharge.

In other words, by expanding a region where the scan electrode Y and the sustain electrode Z and the address electrode X are facing one another, discharge between the scan electrode Y or the sustain electrode Z and the address electrode X is further enhancing to help discharge between the scan electrode Y and the sustain electrode Z. Due to this, it is possible to lower the sustain voltage Vs. In addition, there is an effect that the delay time of the sustain discharge is shortened. At this time, the auxiliary electrodes A1 and A2 formed are determined within a range in which interference does not occur such as the diaphragm and fluorescent material.

Third Embodiment

Figure 13A:
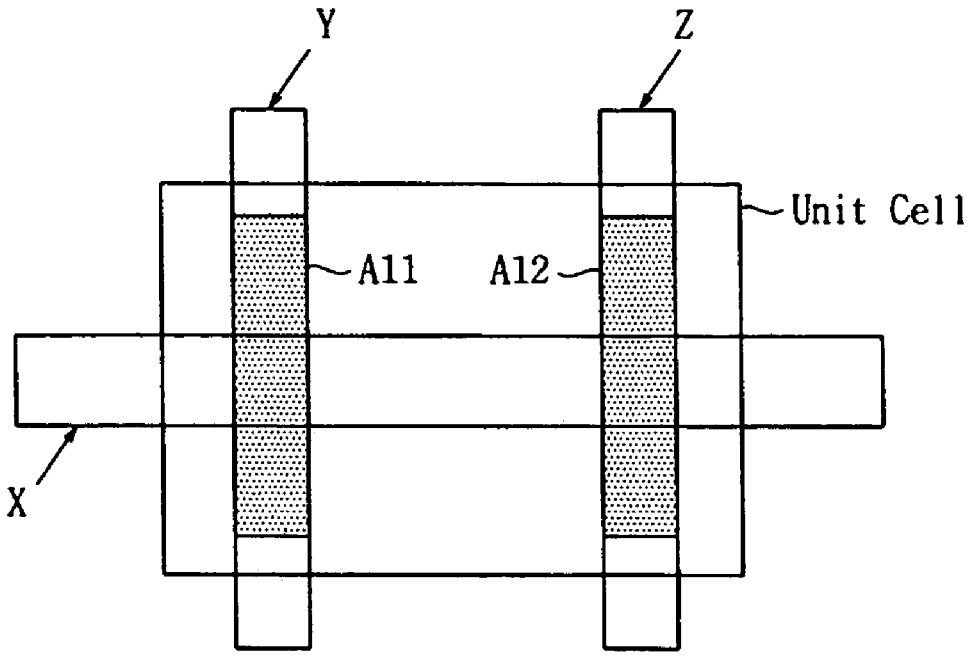
FIG. 13*a* shows an electrode structure according to a third embodiment of the present invention.
Figure 13B:
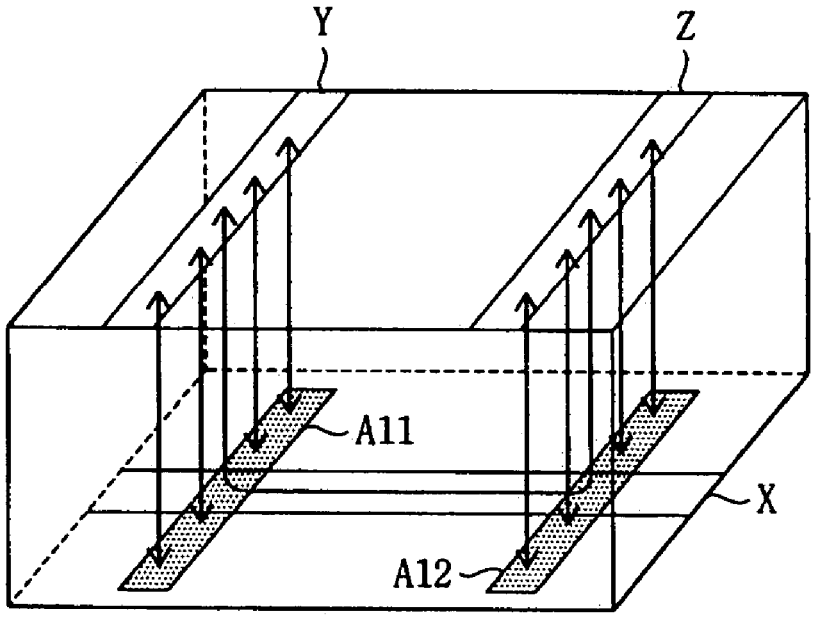
FIG. 13*b* shows an electrode structure according to a third embodiment of the present invention.

FIGS. 13*a* and 13*b* show an electrode structure according to a third embodiment of the present invention.

Referring to FIGS. 13*a* and 13*b*, the electrode structure includes a scan electrode Y and a sustain electrode Z, which are formed in parallel to each other on a upper substrate, an address electrode X formed on a lower substrate so that the address electrode X intersects the scan electrode Y and the sustain electrode Z, and auxiliary electrodes A11 and A12 formed on the address electrode X at places where the scan electrode Y and the sustain electrode Z and the address electrode X intersect.

In the above, the auxiliary electrodes A11 and A12 have a width wider than that of the scan electrode Y and the sustain electrode Z. Furthermore, these auxiliary electrodes A11 and A12 may be formed on the part of only one side of the scan electrode Y and the sustain electrode Z and may be formed so that they extend only in one direction of each electrode.

Fourth Embodiment

Figure 14A:
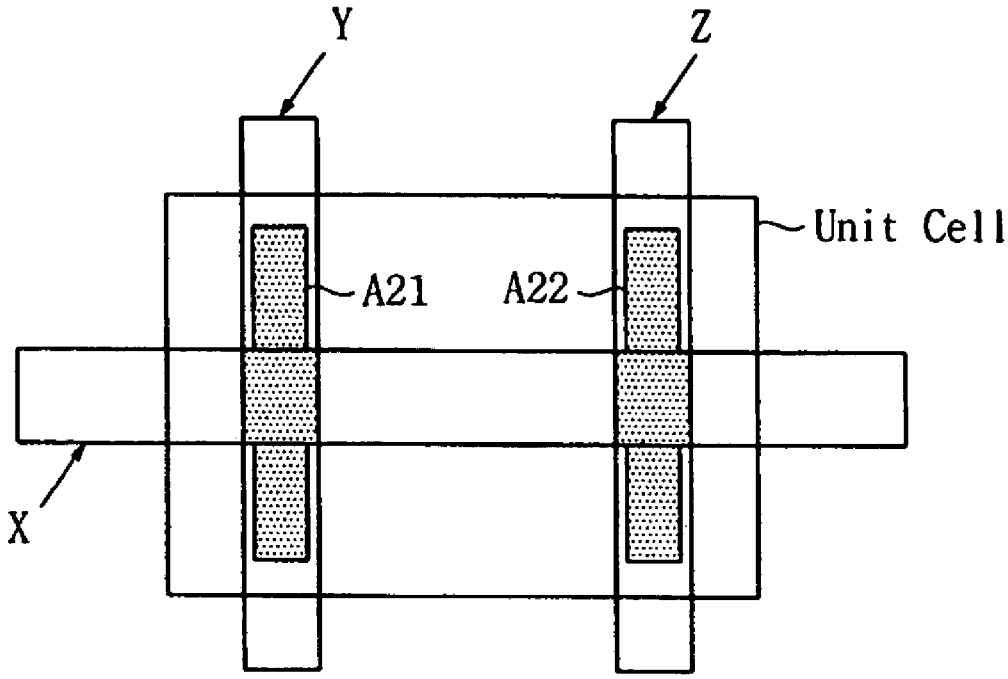
FIG. 14*a* shows an electrode structure according to a fourth embodiment of the present invention.
Figure 14B:
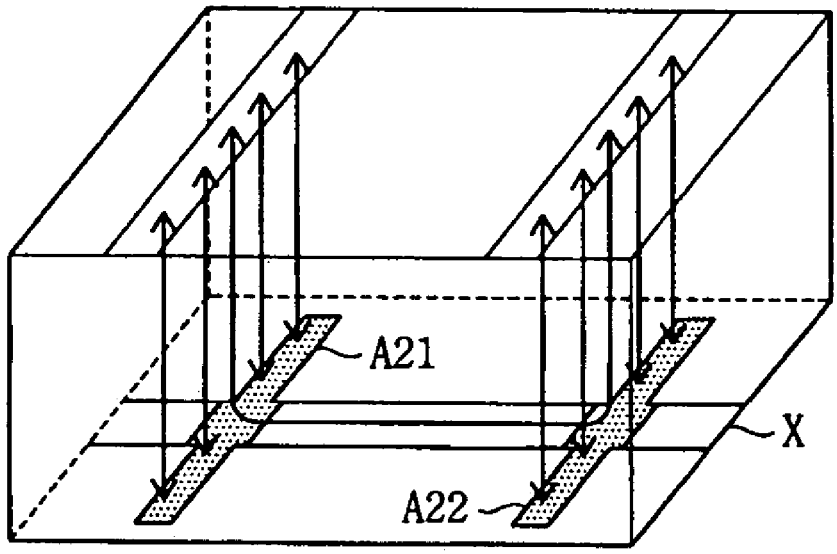
FIG. 14*b* shows an electrode structure according to a fourth embodiment of the present invention.

FIGS. 14*a* and 14*b* shows an electrode structure according to a fourth embodiment of the present invention.

Referring to FIGS. 13*a* and 13*b*, the electrode structure includes a scan electrode Y and a sustain electrode Z, which are formed in parallel to each other on a upper substrate, an address electrode X formed on a lower substrate so that the address electrode X intersects the scan electrode Y and the sustain electrode Z, and auxiliary electrodes A21 and A22 formed on the address electrode X at places where the scan electrode Y and the sustain electrode Z and the address electrode X intersect.

In the above, the auxiliary electrodes A21 and A22 have a width wider than that of the scan electrode Y and the sustain electrode Z. Furthermore, these auxiliary electrodes A21 and A22 may be formed on the part of only one side of the scan electrode Y and the sustain electrode Z and may be formed so that they extend only in one direction of each electrode.

<Method of Driving>

Meanwhile, in case of the positive column structure according to the present invention, the distance between ITO is maximized. The positive column structure must be driven using a mechanism different from the conventional driving waveform.

First, in case of the conventional reset waveform, wall charges are formed through discharge between the scan electrode Y and the sustain electrode Z. The structure according to the present invention, however, is a structure using a structure of a high efficiency by maximizing the distance between the scan electrode Y and the sustain electrode Z. Thus, if the conventional reset waveform is applied to the structure of the present invention, the reset voltage Vreset is increased and at the same time discharge is generated between the scan electrode Y and the address electrode X (or the sustain electrode Z and the address electrode X). Due to this, it is difficult to form a uniform a wall charge, being the object of the reset voltage.

In addition, during the sustain period SPD, if the conventional sustain pulse is alternately applied to the scan electrode Y and the sustain electrode Z and at the same time a bias pulse of the positive polarity is applied to the address electrode X, field distribution become opposite to the scan electrode Y and the sustain electrode Z, thus adversely affecting the sustain discharge.

Accordingly, in order to apply a pulse like the conventional sustain pulse to the scan electrode Y and the sustain electrode Z and the bias pulse of the positive polarity of the sustain pulse to the address electrode X, it is required that the frequency and width be changed. In this case, the picture quality is adversely affected since brightness level properties of each field are varied.

In the present invention, a driving waveform like that shown in FIG. 9 must be applied so that the bias pulse of the positive polarity can be applied to the address electrode X even if the same width and frequency as the prior art are utilized.

Figure 15:
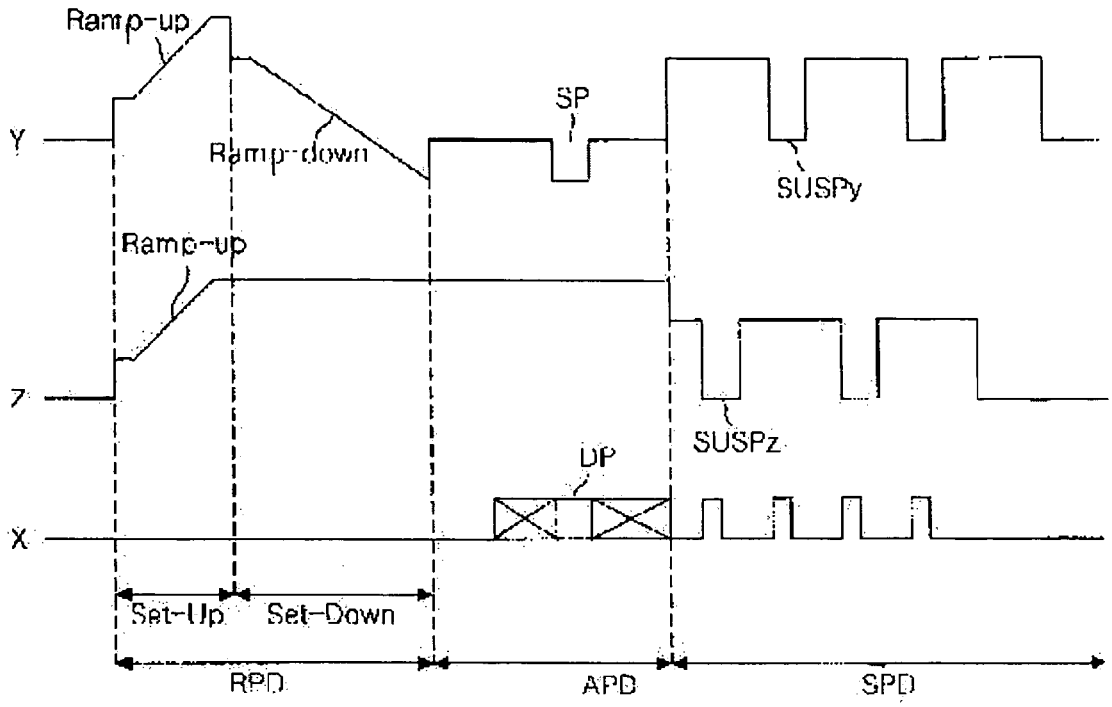
FIG. 15 is a waveform illustrating the method for driving the PDP shown in FIG. 6 according to the present invention.

FIG. 15 is a waveform illustrating the method for driving the PDP shown in FIG. 6 according to the present invention.

Referring to FIG. 15, a sub-field SF included in one frame of the PDP is driven with it divided into a reset period RPD for initializing a cell, an address period APD for selecting the cell, and a sustain period SPD for maintaining discharge of the selected cell.

During the set-up period Set-up of the reset period RPD, a first ramp-up waveform Ramp-up rising from a voltage of the positive polarity (for example, a sustain voltage Vs) is applied to a scan electrode Y. If the first ramp-up waveform is applied to the scan electrode Y, weak discharge is generated between the scan electrode Y and the address electrode X. Wall charges are formed within the cell due to this discharge. Further, during the set-up period, a second ramp-up waveform Ramp-up rising from the voltage of the positive polarity (for example, the sustain voltage Vs) is applied to a sustain electrode Z. If the second ramp-up waveform is applied to the sustain electrode Z, weak discharge is generated between the sustain electrode Z and the address electrode X. Wall charges are formed within the cell due to this discharge.

In other words, during the set-up period Set-up of the present invention, a wall charge having a specific polarity is formed in a discharge cell by generating discharge between the scan electrode Y and the address electrode X, and the sustain electrode Z and the address electrode X. Meanwhile, the voltage values of the first ramp-up waveform Ramp-up and the second ramp-up waveform Ramp-up are set to have a voltage difference to the extent that discharge between the scan electrode Y and the sustain electrode Z does not occur.

For example, the voltage values of the first ramp-up waveform Ramp-up and the second ramp-up waveform Ramp-up can be set to have the same value or a similar value. In this case, the highest voltage value of the first ramp-up waveform Ramp-up and the second ramp-up waveform Ramp-up are set below 350V, preferably below 300V. In the concrete, when the first ramp-up waveform Ramp-up is supplied, a reset discharge is generated between the scan electrode Y and the address electrode X.

In the above, since the structure of the cell is set d>L, that is, since the scan electrode Y and the address electrode X are disposed adjacent to each other, a stabilized reset discharge may happen between the scan electrode Y and the address electrode X due to the first ramp-up waveform Ramp-up having a low voltage value. Similarly, since the second ramp-up waveform Ramp-up is supplied to the sustain electrode Z, a reset discharge does not occur between the scan electrode Y and the sustain electrode Z, but a stabilized reset discharge may happen between the sustain electrode Z and the address electrode X by means of the second ramp-up waveform Ramp-up having a low voltage value.

Meanwhile, the process in which a reset discharge is generated when first and second ramp-up waveforms are applied in the driving waveform according to the present invention will now be described with reference to FIG. 16*a* to FIG. 16*e*. If the first ramp-up waveform Ramp-up is applied to a scan electrode Y, the reset discharge is generated between the scan electrode Y and an address electrode X.

Figure 16A:
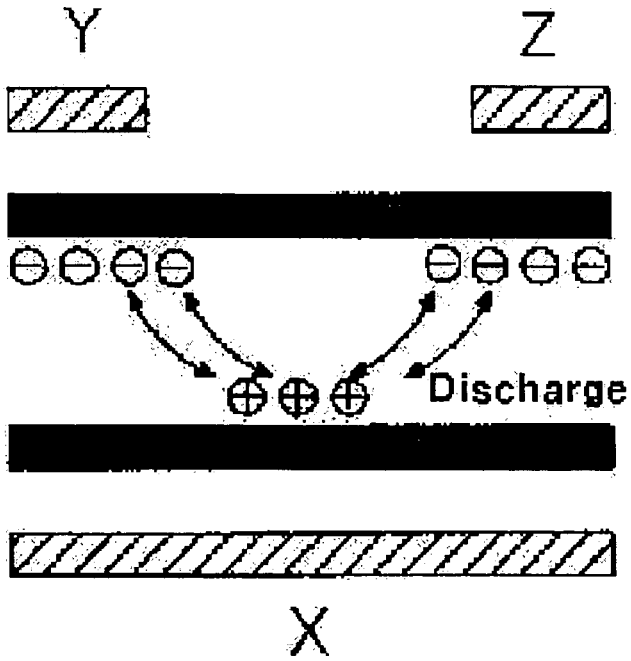
FIG. 16 is a view shown to explain a process in which wall charges are formed according to the driving waveform shown in FIG. 15.

In the above, since the scan electrode Y has a relatively higher voltage than the address electrode X, a wall charge of the negative polarity is formed in the scan electrode Y and a wall charge of the positive polarity is formed in the address electrode X, as shown in FIG. 16*a*. Similarly, if the second ramp-up waveform Ramp-up is applied to a sustain electrode Z, the reset discharge is generated between the sustain electrode Z and the address electrode X. In the above, since the sustain electrode Z relatively has a higher voltage than the address electrode X, a wall charge of the negative polarity is formed in the sustain electrode Z and a wall charge of the positive polarity is formed in the address electrode X, as shown in FIG. 16*a*.

Figure 16B:
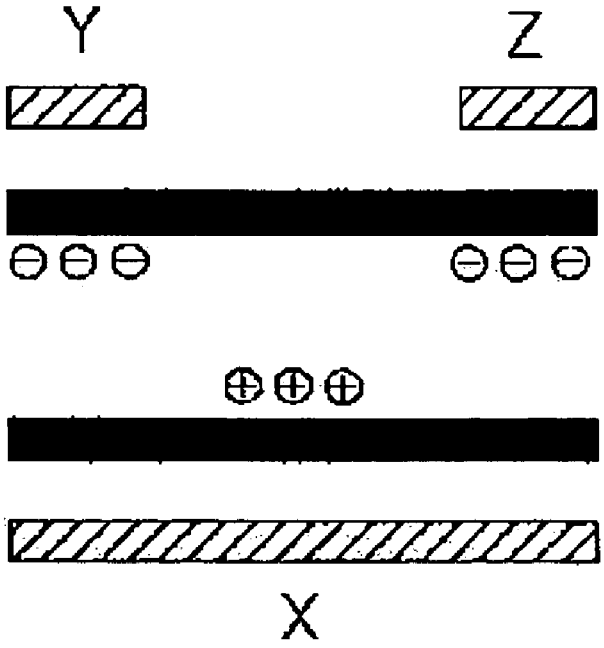

At this time, since voltage values of the first ramp-up waveform Ramp-up and the second ramp-up waveform Ramp-up are set not to generate discharge, the reset discharge is not generated between the scan electrode Y and the sustain electrode Z. Thereafter, during the set-down period Set-down, a ramp-down waveform Ramp-down, which falls from a voltage of the positive polarity to a voltage of the negative polarity, is applied to the scan electrode Y so that desired wall charges can remain. If the ramp-down waveform Ramp-down of the negative polarity is applied, fine discharge is generated between the scan electrode Y and the sustain electrode Z and between the scan electrode Y and the address electrode X. This fine discharge serves to erase unnecessary charges of wall charges and space charges, which are formed during the set-up period Set-up, and make necessary wall charges needed for address discharge remained uniformly within cells of the whole screen, as shown in FIG. 16*b*.

During the address period APD, a scan pulse SP of the negative polarity is sequentially applied to scan electrodes Y and at the same time a data pulse DP of the positive polarity is applied to address electrodes X. An address discharge is generated within a cell to which the data pulse DP is applied, as a voltage difference between the scan pulse SP and the data pulse DP and a wall voltage formed in the reset period RPD are added. Wall charges are generated within cells selected by the address discharge.

Figure 16C:
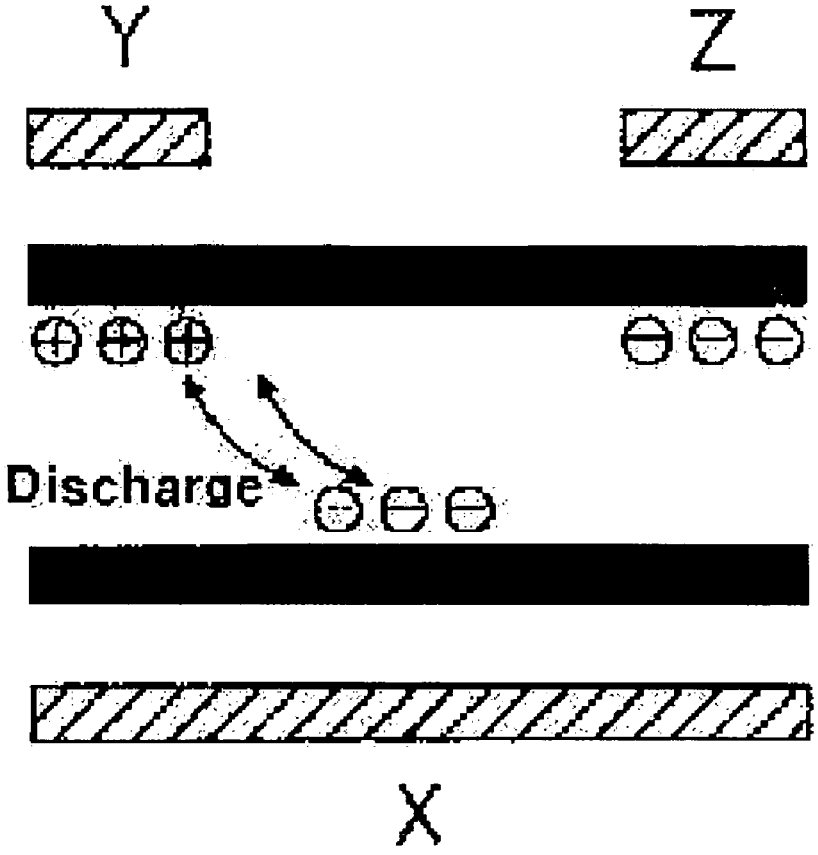

Meanwhile, the process in which the address discharge is generated will now be described with reference to FIG. 16*a* to FIG. 16*e*. If the scan pulse SP of the negative polarity is applied to the scan electrode Y and at the same time the data pulse DP of the positive polarity is applied to the address electrode X, the address discharge is generated between the scan electrode Y and the address electrode X. In the above, since the address electrode X has a voltage relatively higher than the scan electrode Y, wall charges of the positive polarity are formed in the scan electrode Y and wall charges of the negative polarity are formed in the address electrode X, as shown in FIG. 16*c*.

Meanwhile, during the set-down period Set-down and the address period ADP, a positive polarity DC voltage of a voltage level of the second ramp-up waveform Ramp-up is applied to the sustain electrode Z. This DC voltage of the positive polarity serves to keep the wall charges of the negative polarity, which are accumulated in the sustain electrode Z. At this time, the highest voltage value of the DC voltage of the positive polarity is set below 350V, preferably below 300V.

During the sustain period SPD, the sustain pulses SUSPy and SUSPz, which fall from the sustain voltage Vs to the ground voltage, are alternately applied to the scan electrodes Y and the sustain electrodes Z. The sustain pulses SUSPy and SUSPz applied to the scan electrodes Y and the sustain electrodes Z may be pulses, which fall from a specific voltage to a voltage of the negative polarity. In this case, the voltage difference of the pulse, which falls from the specific voltage to the voltage of the negative polarity, has a value of the sustain voltage Vs. At the same time, a bias pulse of the positive polarity is applied to the address electrodes X. Then, a cell selected by the address discharge becomes further the negative polarity as the wall voltage of the negative polarity within the cell and the sustain pulses SUSPy and SUSPz of the negative polarity are added, so that the voltage difference between the sustain electrodes Z and the address electrodes X becomes further increased. Therefore, the sustain discharge is further activated. Such a sustain discharge is generated in a sheet discharge shape between the scan electrodes Y and the sustain electrodes Z every time when the sustain pulses SUSPy and SUSPz are applied.

Meanwhile, the process in which the sustain discharge is generated will now be described with reference to FIG. 16*a* to FIG. 16*e*. If the sustain pulse SUSPz, which falls from the sustain voltage Vs to the ground voltage, is applied to the sustain electrodes Z and at the same time the bias pulse of the positive polarity is applied to the address electrodes X, discharge is generated by a voltage difference between the sustain electrodes Z and the address electrodes X.

In other words, a cell further becomes a voltage of the negative polarity as a voltage of the sustain pulse SUSPz of the negative polarity applied to the sustain electrode Z and a wall voltage of the negative polarity formed in the sustain electrodes Z during the address period APD are added. As a bias pulse of the positive polarity is supplied to the address electrodes X, the voltage difference between the sustain electrodes Z and the address electrodes X is further increased. Therefore, discharge between the sustain electrodes Z and the address electrodes X is actively generated to further activate the sustain discharge between the sustain electrodes Z and the scan electrodes Y.

Figure 16D:
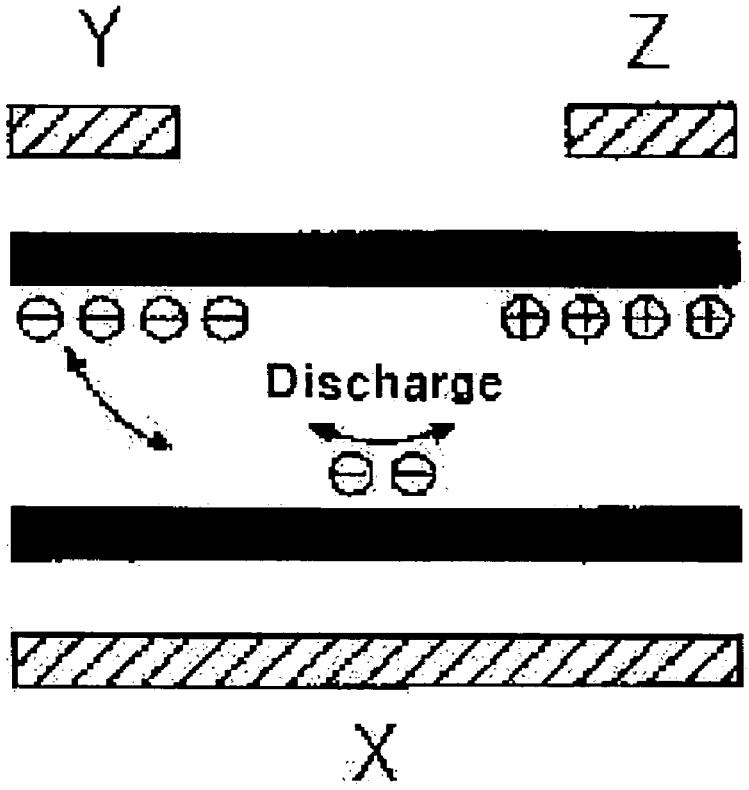

In the above, since the scan electrodes Y has a relatively higher voltage than the sustain electrodes Z, wall charges of the negative polarity are formed in the scan electrodes Y and wall charges of the positive polarity are formed in the sustain electrodes Z, as shown in FIG. 16*d*. Thereafter, if the sustain pulse SUSPz applied to the sustain electrode Z and the sustain pulse SUSPy, which falls the sustain voltage Vs to the ground voltage, are alternately applied to the scan electrodes Y, and at the same time a bias pulse of the positive polarity is applied to the address electrodes X, discharge is generated by a voltage difference between the scan electrodes Y and the address electrodes X.

Figure 16E:
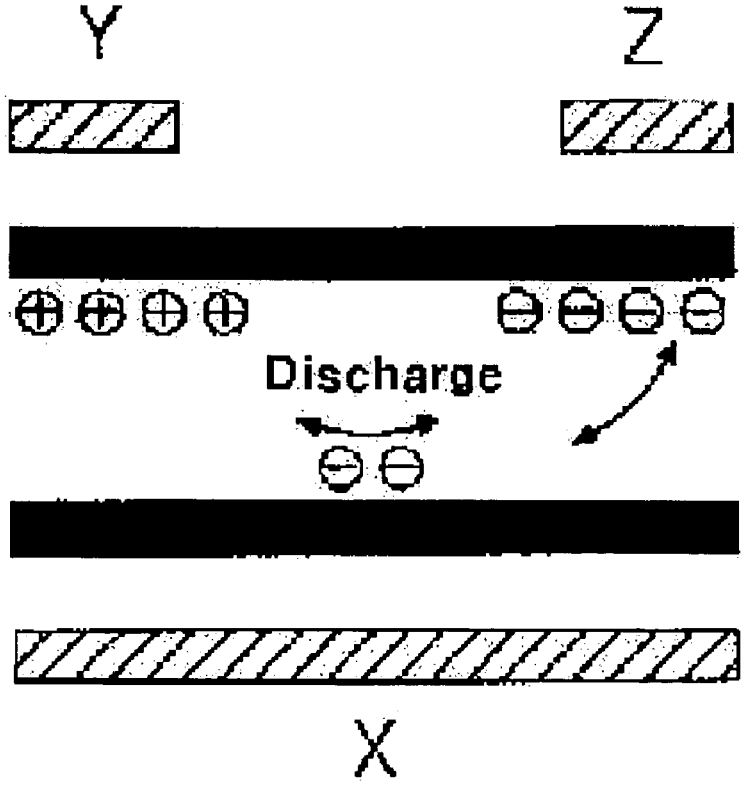

In other words, the cell becomes further a voltage of the negative polarity since the voltage of the sustain pulse SUSPy of the negative polarity applied to the scan electrode Y and the wall voltage of the negative polarity formed in the scan electrode Y by the previous sustain pulse SUSPz are added. Simultaneously, the voltage difference between the scan electrode Y and the address electrode X is further increased since the bias pulse of the positive polarity is applied to the address electrode X. Therefore, discharge between the scan electrode Y and the address electrode X is actively generated to further activate the sustain discharge between the scan electrode Y and the sustain electrode Z. In the above, since the sustain electrode Z has a relatively higher voltage than the scan electrode Y, wall charges of the positive polarity are formed in the scan electrode Y and wall charges of the negative polarity are formed in the sustain electrode Z, as shown in FIG. 16*e*. As such, by alternately generating the sustain discharge, a desired gray scale is displayed.

In other words, the positive column structure according to the present invention is a structure in which the distance between the scan electrode Y and the sustain electrode Z is maximized to expand the positive column in order to increase discharge efficiency. In other words, the positive column is expanded in such a manner that the opposite discharge between the scan electrode Y and the address electrode X is first generated than the sheet discharge between the scan electrode Y and the sustain electrode Z.

Therefore, according to the present invention, a reset voltage is lowered and uniform wall charges are formed in ITO of both upper plate electrodes, by generating a reset discharge between the two plates. By applying this waveform, the present invention has an additional effect that it can significantly reduce brightness of a black pattern, which is generated in the reset discharge between both upper plates ITO in the prior art. Furthermore, the waveform of the present invention makes a relative voltage difference a negative polarity, so that the sustain discharge using wall charges of the negative polarity is generated.

As such, the sustain discharge using the wall charges of the negative polarity is generated in the scan electrode Y and the sustain electrode Z. Thus, by applying the bias pulse of the positive polarity to the address electrode X, not only the sustain discharge using a conventional sustain frequency can be generated but also efficiency of 10~20% can be improved and power consumption can be reduced. The waveform of the present invention is a very useful waveform, which can be used even in the conventional 3-electrode structure in addition to the positive column.

Figure 17:
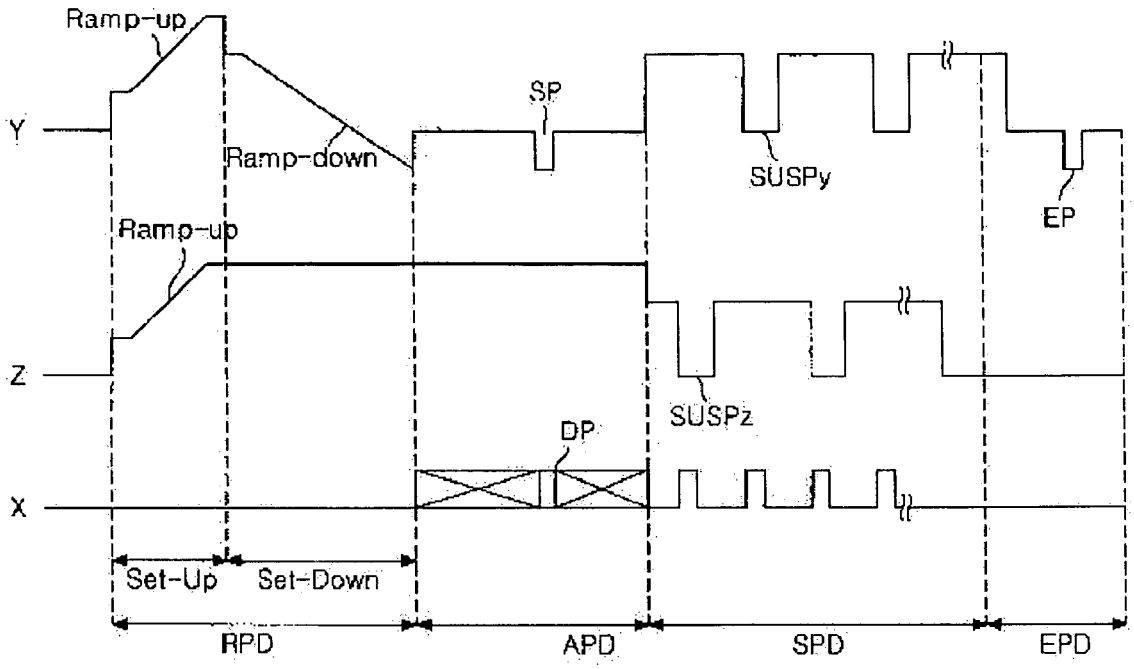
FIG. 17 is a waveform illustrating another method for driving the PDP shown in FIG. 6 according to an embodiment of the present invention.

FIG. 17 is a waveform illustrating another method for driving the PDP shown in FIG. 6 according to an embodiment of the present invention.

Referring to FIG. 17, a sub-field SF included in one frame of the PDP is driven with it divided into a reset period RPD for initializing a cell, an address period APD for selecting the cell, a sustain period SPD for maintaining discharge of the selected cell, and an erase period EPD for erasing wall charges.

In the above, description on the reset period RPD, the address period APD and the sustain period SPD will be omitted since they are same as ones described with reference to FIG. 15.

Figure 18A:
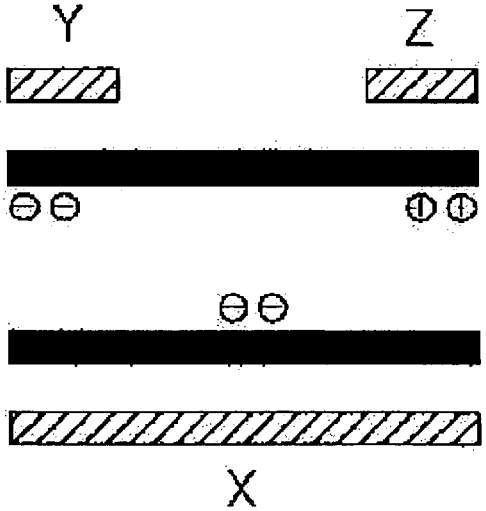
FIG. 18*a* is a view shown to explain a process in which wall charges are formed depending a driving waveform shown in FIG. 17.

Meanwhile, in the erase period EPD following the sustain period SPD, the scan electrode Y falls from the sustain voltage Vs to the ground voltage. At this time, wall charges formed within the discharge cells are erased, However, some of the wall charges are erased and some of them remain in the scan electrode Y and the sustain electrode Z, as shown in FIG. 18*a*.

Figure 18B:
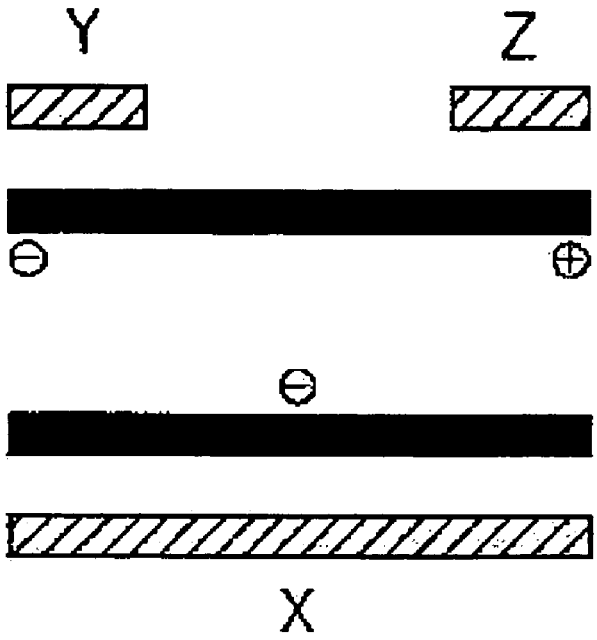
FIG. 18*b* is a view shown to explain a process in which wall charges are formed depending a driving waveform shown in FIG. 17.

Thereafter, the erase pulse EP having a voltage of the negative polarity is applied to all the scan electrodes Y. At this time, the width of the erase pulse EP is set narrow than that of the sustain pulse applied to the scan electrode Y and the sustain electrode Z. If the erase pulse EP of the negative polarity is supplied to the scan electrode Y, erase discharge is generated between the scan electrode Y and the sustain electrode Z. Wall charges formed in the scan electrode Y and the sustain electrode Z in FIG. 18*a* are erased, so that only a small amount of wall charges remain as shown in FIG. 18*b*.

Figure 19A:
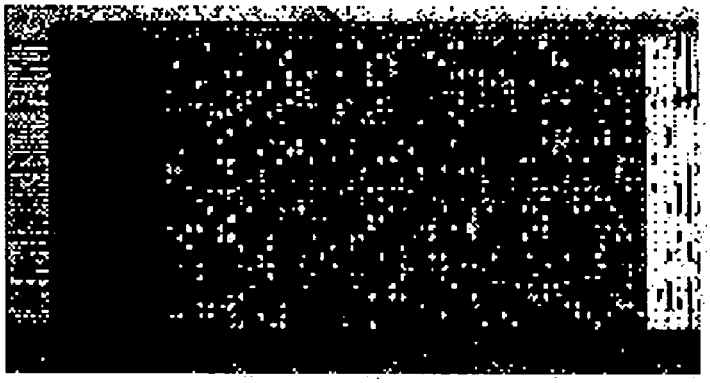
FIG. 19*a* is a view showing a case where erroneous discharge occurs since wall charges are not erased when the waveform shown in FIG. 15 is applied.
Figure 19B:
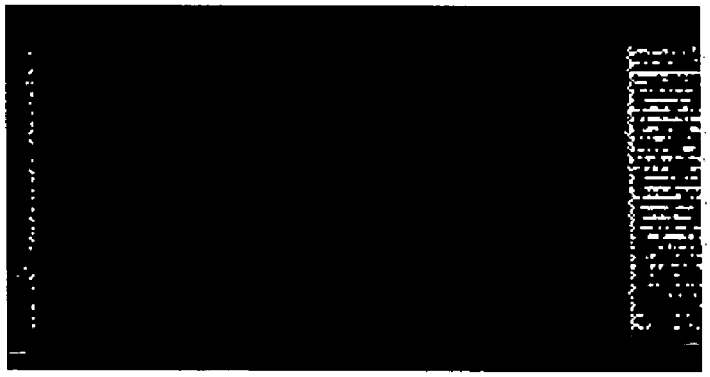
FIG. 19*b* is a view showing a case where erroneous discharge does not occur since wall charges are completely erased when the waveform shown in FIG. 17 is applied.

Therefore, as the small amount of the wall charges remains, erroneous discharge is not generated even the pattern is changed. In particular, although the pattern is changed from a complete white to black, erroneous discharge is not generated. In other words, when the pattern is changed from the complete white to black, erroneous discharge as in FIG. 19*a*, which is generated since the wall charges are not erased, is not generated because the wall charges are completely erased by applying the waveform of the present invention, as shown in FIG. 19*b*.

Meanwhile, such erase pulse EP is applied to all the sub-fields to erase the wall charges.

Figure 20:
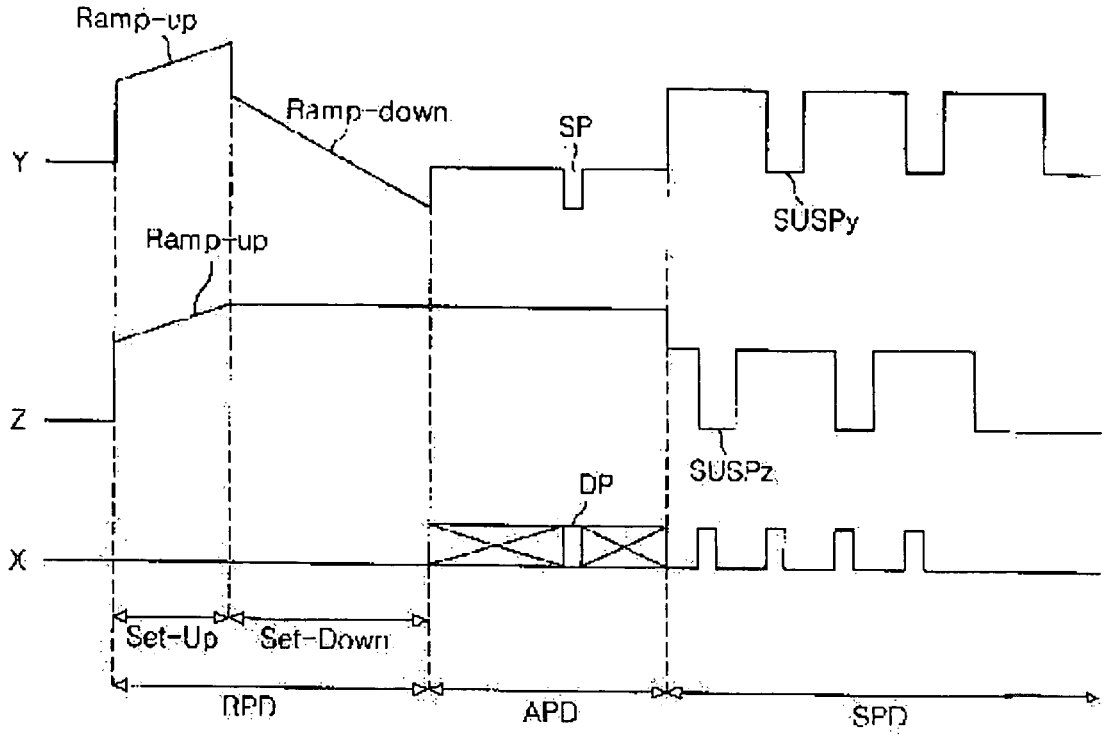
FIG. 20 shows a waveform illustrating another method for driving the PDP shown in FIG. 6 according to an embodiment of the present invention.

FIG. 20 shows a waveform illustrating another method for driving the PDP shown in FIG. 6 according to an embodiment of the present invention.

Referring to FIG. 20, a sub-field SF included in one frame of the PDP is driven with it divided into a reset period RPD for initializing a cell, an address period APD for selecting the cell, and a sustain period SPD for maintaining discharge of the selected cell.

During the set-up period Set-up of the reset period RPD, a first ramp-up waveform Ramp-up rising from a voltage of the positive polarity (for example, a sustain voltage Vs) is applied to a scan electrode Y. If the first ramp-up waveform is applied to the scan electrode Y, weak discharge is generated between the scan electrode Y and the address electrode X. Wall charges are formed within the cell due to this discharge. In the above, since the scan electrode Y has a relatively higher voltage than the address electrode X, wall charges of the negative polarity are formed in the scan electrode Y and wall charges of the positive polarity are formed in the address electrode X, as shown in FIG. 16*a*.

Further, during the set-up period, a second ramp-up waveform Ramp-up rising from the voltage of the positive polarity (for example, the sustain voltage Vs) is applied to a sustain electrode Z. If the second ramp-up waveform is applied to the sustain electrode Z, weak discharge is generated between the sustain electrode Z and the address electrode X. Wall charges are formed within the cell due to this discharge. In the above, since the sustain electrode Z has a relatively higher voltage than the address electrode X, wall charges of the negative polarity are formed in the sustain electrode Z and wall charges of the positive polarity are formed in the address electrode X, as shown in FIG. 16*a*.

At this time, since the voltage values of the first ramp-up waveform Ramp-up and the second ramp-up waveform Ramp-up are set not to generate discharge, the reset discharge is not generated between the scan electrode Y and the sustain electrode Z. Thereafter, during the set-down period Set-down, a ramp-down waveform Ramp-down, which falls a voltage of the positive polarity (for example, the sustain voltage Vs) to a voltage of the negative polarity, is supplied to the scan electrode Y so that desired wall charges can remain. If the ramp-down waveform Ramp-down of the negative polarity is applied, fine discharge occurs between the scan electrode Y and the sustain electrode Z and between the scan electrode Y and the address electrode X. This fine discharge serves to erase unnecessary charges of wall charges and space charges, which are formed during the set-up period Set-up, and make necessary wall charges needed for address discharge remained uniformly within cells of the whole screen, as shown in FIG. 16*b*.

In other words, during the set-up period Set-up of the present invention, wall charges having a specific polarity are formed in a discharge cell since discharge is generated between the scan electrode Y and the address electrode X, and the sustain electrode Z and the address electrode X. Meanwhile, the voltage values of the first ramp-up waveform Ramp-up and the second ramp-up waveform Ramp-up are set to have a voltage difference to the extent that discharge does not occur between the scan electrode Y and the sustain electrode Z. For example, the voltage values of the first ramp-up waveform Ramp-up and the second ramp-up waveform Ramp-up can be set to be same or similar. In this case, the highest voltage values of the first ramp-up waveform Ramp-up and the second ramp-up waveform Ramp-up are set below 350V, preferably below 300V. In the concrete, when the first ramp-up waveform Ramp-up is supplied, a reset discharge is generated between the scan electrode Y and the address electrode X. At this time, since the structure of the cell is set d>L, that is, since the scan electrode Y and the address electrode X are disposed adjacent to each other, stabilized reset discharge may happen between the scan electrode Y and the address electrode X due to the first ramp-up waveform Ramp-up having a low voltage value. Similarly, since the second ramp-up waveform Ramp-up is supplied to the sustain electrode Z, reset discharge does not occur between the scan electrode Y and the sustain electrode Z, but stabilized reset discharge may happen between the sustain electrode Z and the address electrode X by means of the second ramp-up waveform Ramp-up having a low voltage value.

During the address period APD, a scan pulse SP of the negative polarity is sequentially applied to the scan electrodes Y and at the same time a data pulse DP of the positive polarity is applied to the address electrode X. As a voltage difference between the scan pulse SP and the data pulse DP and a wall voltage formed in the reset period RPD are added, an address discharge is generated within a cell to which the data pulse DP is applied. Wall charges are generated within cells selected by the address discharge. In the above, since the address electrode X has a relatively higher voltage than the scan electrode Y, wall charges of the positive polarity are formed in the scan electrode Y and wall charges of the negative polarity are formed in the address electrode X, as shown in FIG. 16*c*.

Meanwhile, during the set-down period Set-down and the address period ADP, a positive polarity DC voltage of a voltage level of the second ramp-up waveform Ramp-up is applied to the sustain electrodes Z. The DC voltage of the positive polarity keeps wall charges of the negative polarity accumulated on the sustain electrodes Z maintained. At this time, the highest voltage value of the DC voltage of the positive polarity is set below 350V, preferably below 300V.

During the sustain period SPD, the sustain pulses SUSPy and SUSPz, which fall from the sustain voltage Vs to the ground voltage, are alternately applied to the scan electrodes Y and the sustain electrodes Z. In the above, the sustain pulses SUSPy and SUSPz applied to the scan electrodes Y and the sustain electrodes Z may be pulses, which fall from a specific voltage to a voltage of the negative polarity. At this time, the voltage difference of the pulse, which falls from the specific voltage to the voltage of the negative polarity, has a value of the sustain voltage Vs. At the same time, a bias pulse of the positive polarity is applied to the address electrode X. Then, a cell selected by the address discharge becomes further the negative polarity as the wall voltage of the negative polarity within the cell and the sustain pulses SUSPy and SUSPz of the negative polarity are added, so that the voltage difference between the sustain electrode Z and the address electrode X becomes further increased. Therefore, the sustain discharge is further activated. At this time, since the scan electrode Y has a relatively higher voltage than the sustain electrode Z, wall charges of the negative polarity is applied to the scan electrode Y and wall charges of the positive polarity are formed in the sustain electrode Z, as shown in FIG. 10*d*. Thereafter, if the sustain pulse SUSPz applied to the sustain electrode Z and the sustain pulse SUSPy, which falls from the sustain voltage Vs to the ground voltage, are alternately applied to the scan electrode Y, and at the same time, a pulse bias of the positive polarity is applied to the address electrode X, discharge is generated between the scan electrode Y and the address electrode X by means of the voltage difference. Therefore, as discharge is actively generated between the scan electrode Y and the address electrode X, the sustain discharge between the scan electrode Y and the sustain electrode Z is further activated. At this time, since the sustain electrode Z has a relatively higher voltage than the scan electrode Y, wall charges of the positive polarity are formed in the scan electrode Y and wall charges of the negative polarity are formed in the sustain electrode Z, as shown in FIG. 16*e*. As such, the sustain discharge is alternately generated to display a desired gray scale.

Meanwhile, the highest voltage value of the first ramp-up waveform Ramp-up and the second ramp-up waveform Ramp-up which are applied in the set-up period Set-up among the reset period RPD of these waveforms, is set below 350V, preferably below 300V.

Figure 21:
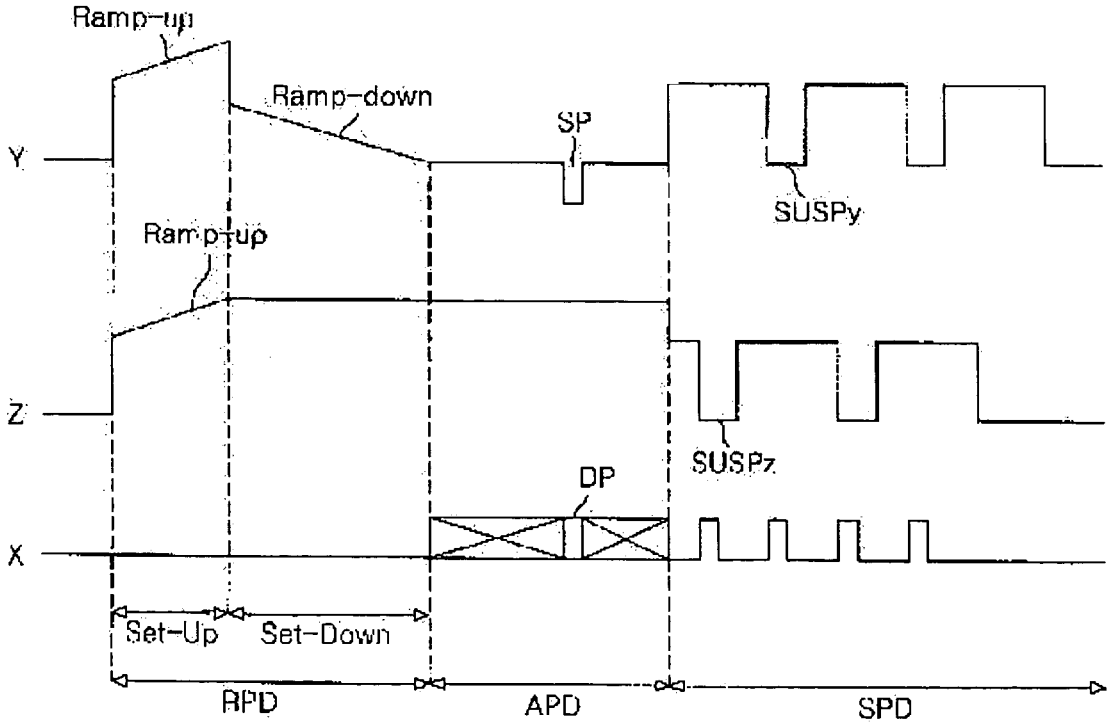
FIG. 21 shows a waveform illustrating another method for driving the PDP shown in FIG. 6 according to an embodiment of the present invention.
Figure 22:
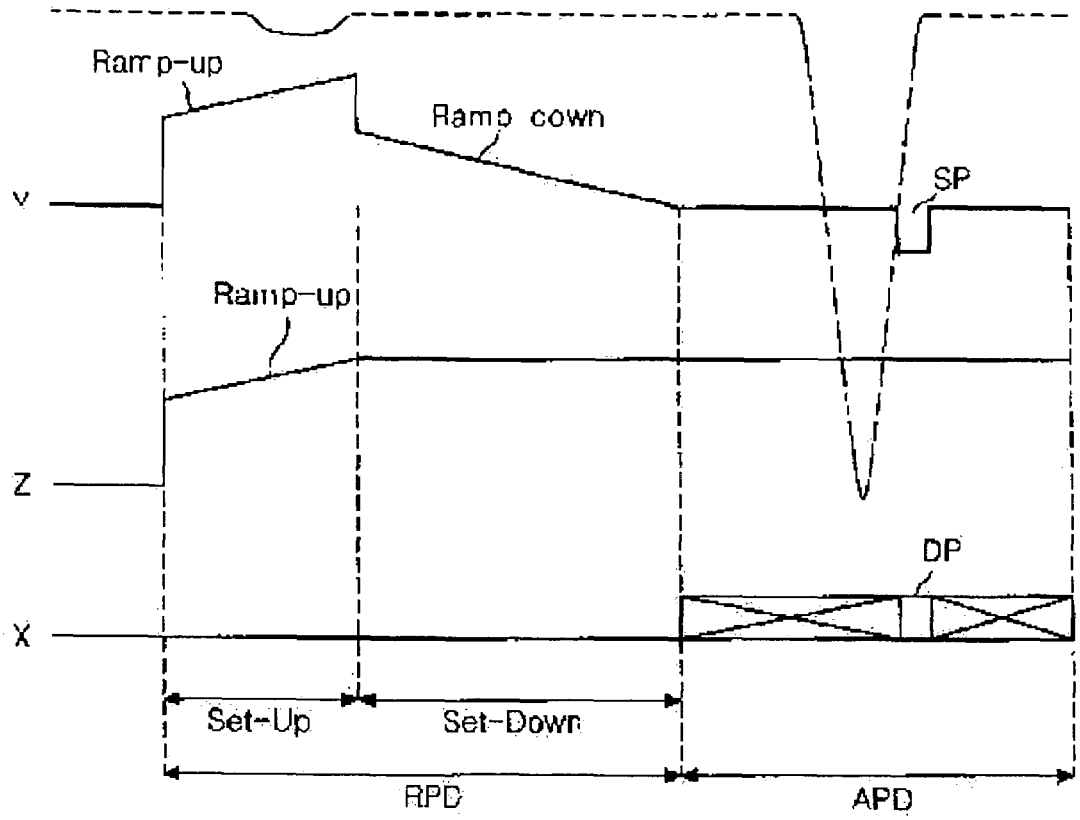
FIG. 22 is a view illustrating a result that the driving waveform shown in FIG. 21 is measured by an optical property system.

FIG. 21 shows a waveform illustrating another method for driving the PDP shown in FIG. 6 according to an embodiment of the present invention.

Referring to FIG. 21, a sub-field SF included in one frame of the PDP is driven with it divided into a reset period RPD for initializing a cell, an address period APD for selecting the cell, and a sustain period SPD for maintaining discharge of the selected cell.

During the set-up period Set-up of the reset period RPD, a first ramp-up waveform Ramp-up, which rises from a first voltage value (for example, below 260V) to the peak voltage value (for example, below 350V, preferably below 260VB), is applied to the scan electrode Y. If the first ramp-up waveform Ramp-up is applied to the scan electrode Y, weak discharge is generated between the scan electrode Y and the address electrode X. Wall charges are formed within cells due to this discharge.

Further, during the set-up period Set-up, a second ramp-up waveform Ramp-up, which rises from a second voltage value (for example, below 260V) to the peak voltage value (for example, below 300V), is applied to the sustain electrode Z. If the second ramp-up waveform Ramp-up is applied to the sustain electrode Z, weak discharge is generated between the sustain electrode Z and the address electrode X. Wall charges are formed within cells due to the discharge.

At this time, since the first voltage value and the second voltage value are set so that they do not cause discharge, a reset discharge is not generated between the scan electrode Y and the sustain electrodes Z. Thereafter, during the set-down period Set-down, the ramp-up waveform is applied so that desired wall charges can remain. Then, the ramp-down waveform Ramp-down, which falls from a third voltage value lower than the first voltage value to a fourth voltage value, is applied to the scan electrode Y at the same time.

In the above, the fourth voltage value may be set to have the ground voltage. At this time, the set-down period Set-down in which the ramp-down waveform Ramp-down falls from the third voltage value to the fourth voltage value, is set to be longer than the set-up period Set-up approximately twice. Accordingly, since not only a voltage at which the ramp-down waveform Ramp-down starts to fall is low but also the inclination is smooth, weak erase discharge is generated. As wall charges generated upon the set-up discharge are erased by this weak erase discharge, it is possible to form uniform wall charges as shown in FIG. 18*b*. It is thus possible to prevent erroneous discharge upon the address discharge.

Meanwhile, the address period APD and the sustain period SPD except for the reset period RPD same as those described with reference to FIG. 9. Description on them will thus be omitted for simplicity.

Figure 23A:
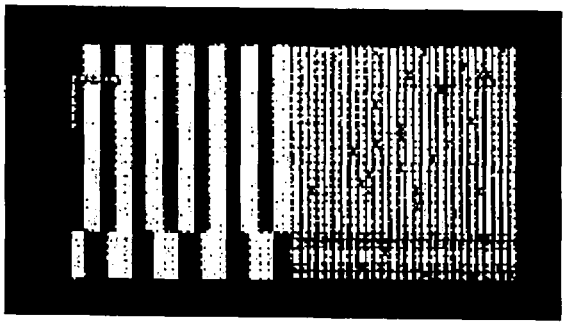
FIG. 23*a* is a view showing a case where erroneous discharge occurs when the waveform shown in FIG. 20 is applied.
Figure 23B:
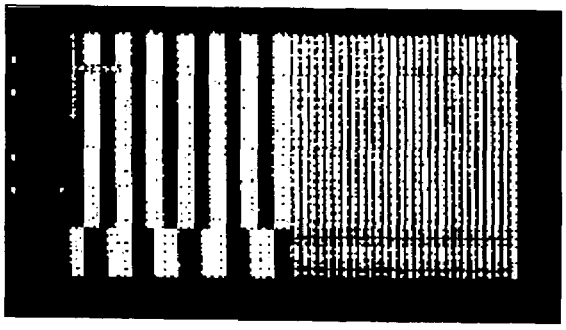
FIG. 23*b* is a view showing a case where erroneous discharge does not occur when the waveform shown in FIG. 21 is applied.

From FIG. 21 showing a result that the driving waveform according to the present invention is measured by an optical property system, it can be seen that discharge is not generated in the set-down period Set-down. Furthermore, it can be seen that erroneous discharge as shown in FIG. 23*a*, which is generated since uniform wall charges are not formed in the set-down period Set-down, is removed by applying the driving waveform according to the present invention, as shown in FIG. 23*b*. In other words, though there is no difference in the white pattern next to erroneous discharge, it can be seen that an erroneous discharge problem is generated as in FIG. 23*a* when representing a gray scale is solved by applying the driving waveform of the present invention, as shown in FIG. 23*b*.

In a plasma display panel according to the present invention, a distance between a scan electrode and a sustain electrode is set greater than that between the scan electrode and an address electrode so that discharge between the scan electrode and the address electrode is first generated. Therefore, the present invention has an effect that it can increase discharge efficiency by increasing a positive column.

Furthermore, an auxiliary electrode is formed on an address electrode in a region where a scan electrode and a sustain electrode and the address electrode intersect. Wall charges accumulated upon the opposite discharge between the scan electrode and the sustain electrode and the address electrode help discharge between the scan electrode and the sustain electrode. It is thus possible to lower the sustain voltage and shorten a delay time of a sustain discharge.

Also, according to the present invention, a reset discharge is generated between a scan electrode or a sustain electrode and an address electrode. It is thus possible to lower a reset voltage and form uniform wall charges in the scan electrode and the sustain electrode.

In addition, the present invention has an effect that it gives a voltage of the negative polarity in terms of a relative level when wall charges of a scan electrode and a sustain electrode have the negative polarity. Accordingly, a sustain discharge may be further activated by applying a bias pulse of the positive polarity to an address electrode.

Further, according to the preset invention, after a sustain discharge is finished, an erase pulse having a voltage of the negative polarity is applied to a scan electrode to erase wall charges accumulated. It is thus possible to prevent erroneous discharge even when a pattern is changed.

Finally, according to the present invention, uniform reset discharge is generated between a pair of sustain electrodes and an address electrode by applying a ramp-down waveform having a smooth inclination in a set-down period among a reset period, so that wall charges are generated. It is thus possible to prevent erroneous discharge upon the address discharge.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel, comprising:

a scan electrode and a sustain electrode, which are formed on an upper substrate in parallel to each other;

an address electrode formed on a lower substrate in the direction where the address electrode intersects the scan electrode and the sustain electrode, wherein a distance d between the scan electrode and the sustain electrode is set wider than a distance L between the scan electrode and the address electrode, and wherein the following relation is satisfied in order to form a positive column in a sustain period:

$d>L$; and an auxiliary electrode formed on the address electrode in a portion where each of the scan electrode and the sustain electrode intersects the address electrode and extended in a direction parallel to the scan electrode and the sustain electrode at the intersecting portion.

2. The plasma display panel as claimed in claim 1, wherein the width of the auxiliary electrode is set wider than that of each of the scan electrode and the sustain electrode.

3. The plasma display panel as claimed in claim 1, wherein the width of the auxiliary electrode is set the same as that of each of the scan electrode and the sustain electrode.

4. The plasma display panel as claimed in claim 1, wherein the width of the auxiliary electrode is set narrower than that of each of the scan electrode and the sustain electrode.

5. The plasma display panel as claimed in claim 1, wherein the auxiliary electrode is extended in one direction in parallel to the scan electrode and the sustain electrode at the intersecting portion.

6. The plasma display panel as claimed in claim 1, wherein the auxiliary electrode is extended in both directions in parallel to the scan electrode and the sustain electrode at the intersecting portion.

7. The plasma display panel as claimed in claim 1, wherein the distance between the sustain electrode and the address electrode is set the same as that between the scan electrode and the address electrode.

8. The plasma display panel as claimed in claim 1, wherein the distance between the scan electrode and the sustain electrode is set 300 μm or more.

* * * * *